US011111453B2

(12) United States Patent
Takeshima

(10) Patent No.: US 11,111,453 B2
(45) Date of Patent: Sep. 7, 2021

(54) METHOD FOR LUBRICATING INTERNAL COMBUSTION ENGINE

(71) Applicant: ENEOS Corporation, Tokyo (JP)

(72) Inventor: Shigeki Takeshima, Tokyo (JP)

(73) Assignee: ENEOS Corporation, Tokyo (JP)

( * ) Notice: Subject to any disclaimer, the term of this patent is extended or adjusted under 35 U.S.C. 154(b) by 63 days.

(21) Appl. No.: 16/341,195

(22) PCT Filed: Oct. 18, 2017

(86) PCT No.: PCT/JP2017/037722
§ 371 (c)(1),
(2) Date: Apr. 11, 2019

(87) PCT Pub. No.: WO2018/074522
PCT Pub. Date: Apr. 26, 2018

(65) Prior Publication Data

US 2019/0233758 A1 Aug. 1, 2019

(30) Foreign Application Priority Data

Oct. 18, 2016 (JP) ..... JP2016-204413

(51) Int. Cl.
*C10M 169/04* (2006.01)
*C10M 129/54* (2006.01)
(Continued)

(52) U.S. Cl.
CPC ..... *C10M 169/04* (2013.01); *C10M 101/02* (2013.01); *C10M 129/26* (2013.01);
(Continued)

(58) Field of Classification Search
CPC ..... C10M 169/04; C10M 129/54; C10M 135/10; C10M 137/02; C10M 133/12;
(Continued)

(56) References Cited

U.S. PATENT DOCUMENTS 5,739,088 A * 4/1998 Inoue ..... C10M 159/22 508/156
2011/0021393 A1 1/2011 Kasai
(Continued)

FOREIGN PATENT DOCUMENTS

EP 1 736 529 A1 12/2006
JP 7-316577 12/1995
(Continued)

OTHER PUBLICATIONS

Cacua Karen et al. "Effects of oxygen enriched air on the operation and performance of a diesel-biogas dual fuel engine," Biomass and Bioenergy, 2012, vol. 45, pp. 159-167.
(Continued)

*Primary Examiner* — Vishal V Vasisth
(74) *Attorney, Agent, or Firm* — Greenblum & Bernstein, P.L.C.

(57) ABSTRACT

A method for lubricating an internal combustion engine, the method including: supplying a lubricating oil composition to a cylinder of an internal combustion engine, wherein the internal combustion engine has a mean effective pressure of no less than 1.3 MPa, wherein an integrated intensity ratio of peaks of CaO in a X-ray diffraction spectrum of an ash is no more than 16.5%, the ash being obtained by incinerating the lubricating oil composition in an air at 950° C.

19 Claims, 2 Drawing Sheets

(51) Int. Cl.

| | |
|---|---|
| ***C10M 135/10*** | (2006.01) |
| ***C10M 137/02*** | (2006.01) |
| ***C10M 133/12*** | (2006.01) |
| ***C10M 139/00*** | (2006.01) |
| ***C10M 101/02*** | (2006.01) |
| ***C10M 159/20*** | (2006.01) |
| ***C10M 159/24*** | (2006.01) |
| ***C10M 171/00*** | (2006.01) |
| ***C10M 129/26*** | (2006.01) |
| *C10N 10/04* | (2006.01) |
| *C10N 20/02* | (2006.01) |
| *C10N 30/04* | (2006.01) |
| *C10N 30/06* | (2006.01) |
| *C10N 30/10* | (2006.01) |
| *C10N 40/25* | (2006.01) |

(52) U.S. Cl.

CPC ..... *C10M 129/54* (2013.01); *C10M 133/12* (2013.01); *C10M 135/10* (2013.01); *C10M 137/02* (2013.01); *C10M 139/00* (2013.01); *C10M 159/20* (2013.01); *C10M 159/24* (2013.01); *C10M 171/00* (2013.01); *C10M 2203/1025* (2013.01); *C10M 2207/144* (2013.01); *C10M 2215/064* (2013.01); *C10M 2219/044* (2013.01); *C10M 2223/02* (2013.01); *C10M 2227/09* (2013.01); *C10N 2010/04* (2013.01); *C10N 2020/02* (2013.01); *C10N 2030/04* (2013.01); *C10N 2030/06* (2013.01); *C10N 2030/10* (2013.01); *C10N 2040/255* (2020.05)

(58) Field of Classification Search

CPC ..... C10M 139/00; C10M 101/02; C10M 2227/09; C10M 2203/1025; C10M 2207/144; C10M 2215/064; C10M 2219/044; C10M 2223/02; C10N 2010/04; C10N 2060/14; C10N 2040/25

See application file for complete search history.

(56) References Cited

U.S. PATENT DOCUMENTS

| | | | |
|---|---|---|---|
| 2012/0283157 | A1 | 11/2012 | Matsui et al. |
| 2015/0218482 | A1 | 8/2015 | Ito et al. |
| 2015/0322369 | A1* | 11/2015 | Patel ..... C10M 125/24 508/162 |
| 2016/0348027 | A1 | 12/2016 | Utaka |
| 2017/0022441 | A1 | 1/2017 | Onodera et al. |
| 2017/0298287 | A1 | 10/2017 | Tamura |
| 2018/0334636 | A1 | 11/2018 | Hoshino et al. |
| 2018/0346842 | A1 | 12/2018 | Takeshima |

FOREIGN PATENT DOCUMENTS

| | | |
|---|---|---|
| JP | 2014-152301 | 8/2014 |
| JP | 2014-196517 | 10/2014 |
| JP | 5727701 | 4/2015 |
| JP | 2015-140354 | 8/2015 |
| JP | 2015-143304 | 8/2015 |
| WO | 96/37582 | 11/1996 |
| WO | 2011/083602 | 7/2011 |
| WO | 2015/023559 | 2/2015 |
| WO | 2015/042337 | 3/2015 |
| WO | 2015/042340 | 3/2015 |
| WO | 2015/042341 | 3/2015 |
| WO | 2015/111746 | 7/2015 |
| WO | 2015/114920 | 8/2015 |
| WO | 2015/171980 | 11/2015 |
| WO | 2016/043333 | 3/2016 |
| WO | 2017/057361 | 4/2017 |
| WO | 2017/099052 | 6/2017 |

OTHER PUBLICATIONS

K. Fujimoto et al., "Engine Oil Development for Preventing Pre-Ignition in Turbocharged Gasoline Engine", SAE Int. J. Fuels Lubr., 7(3),, 2014, pp. 869-874.

S. Yasueda et al., "Predicting Autoignition caused by Lubricating Oil in Gas Engines", 27th CIMAC Congress Paper No. 37, May 2013.

S. Yasueda, "The Examination on the Main Contributing Factors of Lube Oil Pre-Ignition", 28th CIMAC Congress paper No. 147, Jun. 2016.

Official Communication issued in International Bureau of WIPO Patent Application No. PCT/JP2017/037722, dated Nov. 28, 2017.

IPRP issued in International Bureau of WIPO Patent Application No. PCT/JP2017/037722, dated Apr. 23, 2019 with English translation.

K. Takeuchi et al., "Investigations of Engine Oil Effect on Abnormal Combustion in Turbocharged Direct Injection—Spark Ignition Engines (Part 1)—Preventing or Contributing to Low-Speed Pre-Ignition through Effects of Engine Oil Additives", Proceedings of JSAE Annual Congress , May 25, 2012, pp. 1-4, No. 70-12; Abstract.

K. Fujimoto et al., "Investigations of Engine Oil Effect on Abnormal Combustion in Turbocharged Direct Injection—Spark Ignition Engines (Second Report)—Correlation between Auto-Ignition Temperature of Engine Oil and Low-Speed Pre-Ignition Frequency", Proceedings of JSAE Annual Congress, May 25, 2012, pp. 5-8, No. 70-12; Abstract.

Y. Seki et al., "An Analysis of the mechanism of Pre-ignition in turbo-charged Direct injection spark ignition engines", Proceedings of JSAE Annual Congress , Oct. 22, 2014, pp. 23-28, No. 94-14; Abstract.

Y. Okada et al., "Study of LSPI Occurring Mechanism from Deposit", Proceedings of JSAE Annual Congress, Oct. 22, 2014, pp. 11-16, No. 94-14; Abstract.

Takayuki Hirose et al., "Development of low-pressure gas injection type 2-stroke gas engine," Journal of the JIME, 2014, pp. 7-12, vol. 49, No. 1; English translation.

* cited by examiner

METHOD FOR LUBRICATING INTERNAL COMBUSTION ENGINE

This application is a 371 of PCT/JP2017/037722, filed Oct. 18, 2017.

FIELD

The present invention relates to methods for lubricating internal combustion engines, and particularly to a method for lubricating an internal combustion engine wherein the method can suppress preignition.

BACKGROUND

Internal combustion engines support most of modern transportation. As regards automobile engines, it has been recently proposed to replace conventional natural aspiration engines with turbocharged engines having smaller displacements (turbocharged downsized engines), so as to reduce fuel consumption of, in particular, automobile gasoline engines. A turbocharged downsized engine is equipped with a turbocharger, which makes it possible to reduce a displacement while maintaining power, and thus to reduce fuel consumption.

CITATION LIST

Patent Literature

Patent Literature 1: WO 2015/114920 A1
Patent Literature 2: JP H7-316577 A
Patent Literature 3: JP 2014-152301 A
Patent Literature 4: JP 2015-143304 A
Patent Literature 5: JP 2015-140354 A
Patent Literature 6: JP 5727701 B
Patent Literature 7: WO 2015/111746 A1
Patent Literature 8: WO 2015/042337 A1
Patent Literature 9: WO 2015/042340 A1
Patent Literature 10: WO 2015/042341 A1
Patent Literature 11: WO 2015/023559 A1
Patent Literature 12: WO 2016/043333 A1
Patent Literature 13: WO 2017/099052 A1
Patent Literature 14: WO 2017/057361 A1
Patent Literature 15: WO 2014-196517 A1

Non Patent Literature

Non Patent Literature 1: Takeuchi, K.; Ito, Y.; Fujimoto, K., "Investigations of Engine Oil Effect on Abnormal Combustion in Turbocharged Direct Injection—Spark Ignition Engines (Part 1) —Preventing or Contributing to Low-Speed Pre-Ignition through Effects of Engine Oil Additives", Proceedings of JSAE Annual Congress 2012, No. 70-12, pp. 1-4, 20125101 (May 25, 2012, JSAE Annual Congress (Spring)).

Non Patent Literature 2: Fujimoto, K.; Yamashita, M.; Kaneko, T.; Takeuchi, K.; Ito, Y.; Matsuda, H., "Investigations of Engine Oil Effect on Abnormal Combustion in Turbocharged Direct Injection—Spark Ignition Engines (Second Report) —Correlation between Auto-Ignition Temperature of Engine Oil and Low-Speed Pre-Ignition Frequency", Proceedings of JSAE Annual Congress 2012, No. 70-12, pp. 5-8, 20125109 (May 25, 2012, JSAE Annual Congress (Spring)).

Non Patent Literature 3: Okada, Y.; Miyashita, S.; Yaguchi, H.; Izumi, Y.; Aoki, F., "Study of LSPI Occurring Mechanism from Deposit", Proceedings of JSAE Annual Congress 2014, No. 94-14, pp. 11-16, 20145633 (Oct. 22, 2014, JSAE Annual Congress (Autumn)).

Non Patent Literature 4: Seki, Y.; Negoro, K.; Sato, Y.; Matsuura, K.; Nishi, M.; lida, N., "An Analysis of the mechanism of Pre-ignition in turbo-charged Direct injection spark ignition engines", Proceedings of JSAE Annual Congress 2014, No. 94-14, pp. 23-28, 20145825 (Oct. 22, 2014, JSAE Annual Congress (Autumn)).

Non Patent Literature 5: Fujimoto, K.; Yamashita M.; Hirano, S.; Kato, K., et al., "Engine Oil Development for Preventing Pre-Ignition in Turbocharged Gasoline Engine", SAE Int. J. Fuels Lubr. 2014, 7(3), 869-874. doi:10.4271/2014-01-2785.

Non Patent Literature 6: Yasueda, S.; Tozzi, L.; Sotiropoulou, E., "Predicting Autoignition caused by Lubricating Oil in Gas Engines", 27th CIMAC Congress Paper No. 37, May 2013, Shanghai Non Patent Literature 7: Yasueda, S.; Kuboyama, T.; Matsumura, M., et al., "The Examination on the Main Contributing Factors of Lube Oil Pre-ignition", 28th CIMAC Congress paper No. 147, June 2016, Helsinki

SUMMARY

Technical Problem

A turbocharged downsized engine may suffer a phenomenon that ignition occurs in a cylinder earlier than expected (i.e., prior to spark ignition) when torque increases in a low speed range (LSPI: Low Speed Pre-Ignition). LSPI increases energy loss, and leads to restrictions on improvements of fuel efficiency and low-speed torque. It is suspected that an engine oil has an influence on occurrence of LSPI.

As regards marine engines, IMO (International Maritime Organization) has decided to tighten regulations over exhaust gases from marine vessels in view of environmental preservation. For example, it has been obliged to use a fuel having a sulfur content of no more than 0.1 mass % (ULSFO) in regulated sea areas called ECA (Emission Control Area) since 2015, and a further regulation, which obliges marine vessels without an exhaust gas desulfurizer to use a fuel having a sulfur content of no more than 0.5 mass % even in general sea areas from 2020 (or 2025), is under consideration.

So as to comply with such regulations, low-sulfur fuels (sulfur content 0.1 mass % or less) made from a topped oil or a hydrocracking bottom are marketed. And also, marine engines which can use substantially sulfur-free low boiling point fuels (hereinafter may be referred to as "specific fuels") such as liquefied natural gas (LNG), compressed natural gas (CNG), liquefied petroleum gas (LPG), ethylene, methanol, ethanol and dimethyl ether have been developed. These specific fuels include hydrocarbons having a carbon number of 1 to 4, and have low boiling points and low flash points. These specific fuels are also advantageous in that they are sulfur-free (sulfur content: 10 mass ppm or less) and thus do not cause catalyst poisoning by sulfur in an exhaust gas post treatment system. In particular, a natural gas is advantageous in view of reduction of fuel consumption as well because of lower $CO_2$ emission per same heat compared to petroleum fuels such as topped oils and heavy oils, and is expected to be supplied more stably and more inexpensively than petroleum fuels in the future owing to development of shale gas wells.

As marine engines using specific fuels, diesel cycle engines (gas injection engines) and premix combustion engines (low-pressure premix combustion engines, which are also referred to as Otto cycle engines) have been proposed. A diesel cycle engine injects a pilot fuel (generally a petroleum fuel) into a combustion chamber in advance, and then injects a main fuel (specific fuel) at the timing of combustion to ignite the fuel. A premix combustion engine mixes a main fuel (specific fuel) and an air in a combustion chamber to form a fuel-air mixture in advance, and then injects a pilot fuel (generally a petroleum fuel such as a heavy fuel) at the timing of combustion to ignite the fuel (dual fuel engine). The premix combustion engine is more advantageous than the diesel cycle engine in that required pump pressure of a pump to introduce the main fuel into the combustion chamber is low. This advantage is significant when gaseous fuels such as natural gasses are used as the main fuel.

Regarding premix combustion engines, however, it has been reported that a phenomenon that the fuel-air mixture ignites to burn before injection of the pilot fuel (Pre-ignition) occurs. An engine oil is suspected to be involved in the preignition in premix combustion engines as well.

So as to reduce ISPI or preignition (in the present specification, "preignition" shall encompass LSPI.), it has been proposed to reduce an amount of a calcium detergent in an engine oil, or to replace part of the calcium detergent in the engine oil with a magnesium detergent overbased with magnesium carbonate. However, reduction of a metallic detergent content in an engine oil leads to lower detergency and acid-neutralization performance. Replacing part of a calcium detergent in an engine oil with a magnesium detergent on one hand makes it possible to avoid deterioration of detergency and acid-neutralization performance, but on the other hand may lead to deposition of hard magnesium-based ash such as $MgCO_3$ and MgO on a piston surface, and to formation of needle crystals by reaction with water formed by combustion, which may lead to fouling of an oil filter.

An object of the present invention is to provide a method for lubricating an internal combustion engine wherein the method makes it possible to suppress preignition without deterioration of detergency and acid-neutralization performance even when a large amount of a magnesium detergent is not incorporated in a lubricating oil composition. A lubricating oil composition for an internal combustion engine which can be suitably used in the method is also provided.

Solution to Problem

The present invention encompasses the following aspects [1] to [15]:

[1] A method for lubricating an internal combustion engine, the method comprising: supplying a lubricating oil composition to a cylinder of an internal combustion engine, wherein the internal combustion engine has a mean effective pressure of no less than 1.3 MPa, wherein an integrated intensity ratio of peaks of CaO in a X-ray diffraction spectrum of an ash is no more than 16.5%, the ash being obtained by incinerating the lubricating oil composition in an air at 950° C.

In the present specification, the "integrated intensity ratio of peaks of CaO in a X-ray diffraction spectrum" means a ratio of a total integrated intensity of all peaks derived from CaO to a total integrated intensity of all peaks in the X-ray diffraction spectrum. That "the integrated intensity ratio of peaks of CaO in a X-ray diffraction spectrum of an ash is no more than 16.5%, wherein the ash is obtained by incinerating the lubricating oil composition in an air at 950° C." does not require that the method for lubricating the internal combustion engine comprises a step of incinerating the lubricating oil composition. That the method for lubricating the internal combustion engine "comprises supplying the lubricating oil composition to a cylinder of the internal combustion engine" does not exclude an embodiment in which the lubricating oil composition is supplied to a point other than the cylinder as well, as long as the lubricating oil composition is supplied at least to the cylinder of the internal combustion engine.

[2] The method according to [1], the lubricating oil composition comprising: a mineral base oil or a synthetic base oil or a mixture thereof, as a lubricant base oil; and (A) a metallic detergent, wherein a molar ratio B/Ca of a boron content B (unit: mol) of the lubricating oil composition derived from the component (A) and a calcium content Ca (unit: mol) of the lubricating oil composition derived from the component (A) is no less than 0.52.

[3] The method according to [2], the component (A) comprising: (A1) a calcium borate-containing carboxylate detergent, and/or a calcium borate-containing sulfonate detergent.

[4] The method according to [3], the component (A) further comprising: (A2) a calcium carbonate-containing metallic detergent.

[5] The method according to any one of [2] to [4], the lubricating oil composition further comprising one or more selected from the group consisting of: (B) an ashless dispersant, (C) a phosphorus-containing anti-wear agent, (D) an amine antioxidant, and (E) an oil-soluble organic molybdenum compound.

[6] The method according to any one of [1] to [5], wherein the internal combustion engine is a turbocharged gasoline engine.

[7] The method according to any one of [1] to [5], the internal combustion engine being a premix combustion medium-speed trunk piston diesel engine using a first fuel as a main fuel, or a premix combustion crosshead diesel engine using the first fuel as a main fuel, wherein the first fuel has a flash point of no more than 15° C.

[8] The method according to [7], the method comprising: operating the internal combustion engine using the first fuel as a main fuel.

[9] The method according to [8] the first fuel comprising a hydrocarbon having a carbon number of 1 to 4.

[10] The method according to [8] or [9], the first fuel comprising one or more selected from the group consisting of: methane, ethane, ethylene, propane, butane, methanol, ethanol, and dimethyl ether.

[11] A lubricating oil composition for an internal combustion engine, the lubricating oil composition comprising: a mineral base oil or a synthetic base oil or a mixture thereof, as a lubricant base oil; and (A) a metallic detergent, wherein an integrated intensity ratio of peaks of CaO in a X-ray diffraction spectrum of an ash is no more than 16.5%, the ash being obtained by incinerating the lubricating oil composition in an air at 950° C.; and a molar ratio B/Ca of a boron content B (unit: mol) of the lubricating oil composition derived from the component (A) and a calcium content Ca (unit: mol) of the lubricating oil composition derived from the component (A) is no less than 0.52.

[12] The lubricating oil composition according to [11], the component (A) comprising: (A1) a calcium borate-containing carboxylate detergent, and/or a calcium borate-containing sulfonate detergent.

[13] The lubricating oil composition according to [12], the component (A) further comprising: (A2) a calcium carbonate-containing metallic detergent.

[14] The lubricating oil composition according to any one of [11] to [13], further comprising: one or more selected from the group consisting of: (B) an ashless dispersant, (C) a phosphorus-containing anti-wear agent, (D) an amine antioxidant, and (E) an oil-soluble organic molybdenum compound.

[15] The lubricating oil composition according to any one of [11] to [14], wherein the lubricating oil composition is used to lubricate at least a cylinder in a turbocharged gasoline engine, or in a premix combustion middle-speed trunk piston diesel engine using a first fuel as a main fuel, or in a premix combustion crosshead diesel engine using the first fuel as a main fuel, wherein the first fuel has a flash point of no more than 15° C.

Advantageous Effects of Invention

The method for lubricating an internal combustion engine of the present invention makes it possible to suppress preignition without deteriorating detergency and acid-neutralization performance even when a large amount of a magnesium detergent is not incorporated in a lubricating oil composition.

The lubricating oil composition for an internal combustion engine of the present invention may be preferably used in the method for lubricating an internal combustion engine of the present invention.

DETAILED DESCRIPTION OF EMBODIMENTS

Figure 1:
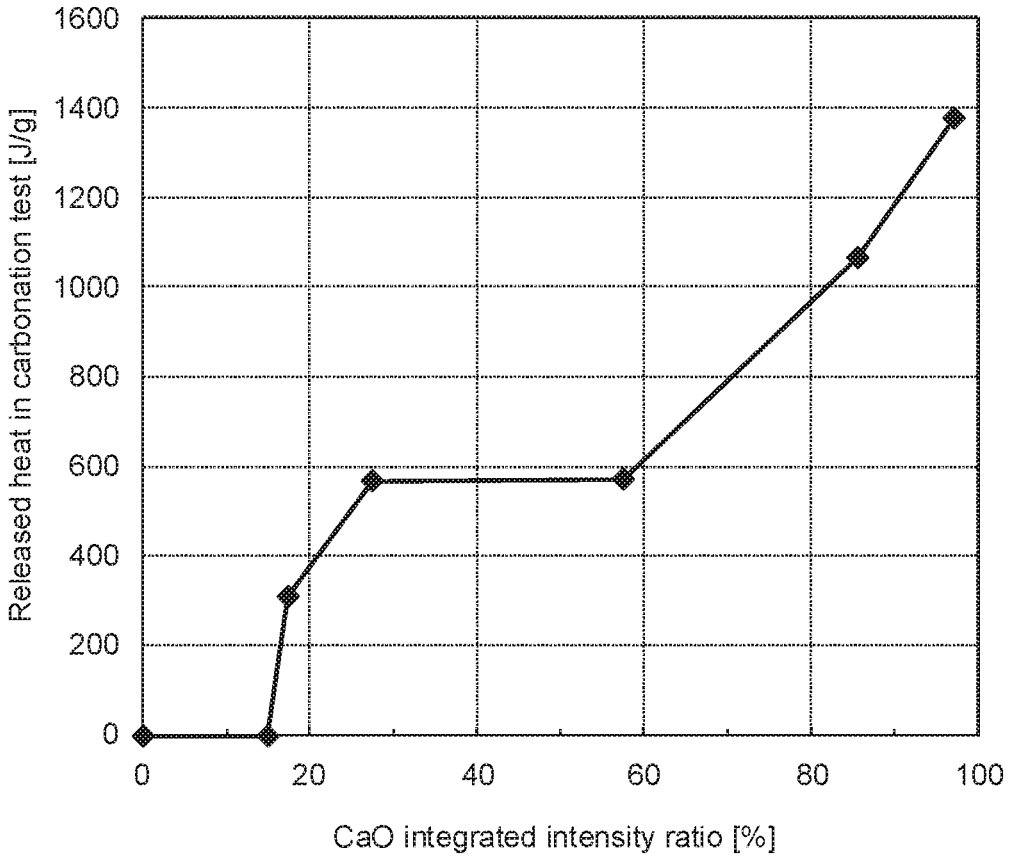
FIG. 1 is a graph showing a relation between integrated intensity ratios of peaks derived from CaO in X-ray diffraction spectra of ashes in Reference Examples, and released heat in carbonation tests of the ashes.

The present invention will be described hereinafter. Expression "A to B" concerning numeral values A and B means "no less than A and no more than B" unless otherwise specified. In such expression, if a unit is added only to the numeral value B, the unit is applied to the numeral value A as well. A word "or" means a logical sum unless otherwise specified. Concerning elements $X_1$ and $X_2$, expression "$X_1$ and/or $X_2$" means "$X_1$ or $X_2$ or any combination thereof". Concerning elements $X_1, \ldots, X_N$ ($N \geq 3$), expression "$X_1, \ldots, X_{N-1}$ and/or $X_N$" means "$X_1, \ldots, X_{N-1}$ or $X_N$ or any combination thereof".

<Method for Lubricating Internal Combustion Engine>

The method for lubricating an internal combustion engine of the present invention comprises: supplying a lubricating oil composition to a cylinder of an internal combustion engine, wherein the internal combustion engine has a mean effective pressure of no less than 1.3 MPa, wherein an integrated intensity ratio of peaks of CaO in a X-ray diffraction spectrum of an ash is no more than 16.5%, the ash being obtained by incinerating the lubricating oil composition in an air at 950° C.

It is necessary that an integrated intensity ratio of peaks of CaO in a X-ray diffraction spectrum of an ash be no more than 16.5%, the ash being obtained by incinerating a lubricating oil composition in an air at 950° C. For example, this integrated intensity ratio may be no more than 15.0%. The integrated intensity ratio of peaks of CaO in a X-ray diffraction spectrum of an ash of this upper limit or lower makes it possible to suppress an exothermic reaction of ash particles scattered in a cylinder with carbon dioxide in an atmosphere in the cylinder, and thus makes it possible to suppress a preignition phenomenon in which the ash particle scattered in the cylinder work as ignition sources. The integrated intensity ratio of peaks of CaO in a X-ray diffraction spectrum of an ash may be 0%.

In the present specification, the "integrated intensity ratio of peaks of CaO in a X-ray diffraction spectrum" means a ratio of a total integrated intensity of peaks derived from CaO to a total integrated intensity of all peaks in a X-ray diffraction spectrum which plots diffracted X-ray intensity (unit: cps) along the vertical axis against a diffraction angle 2θ (unit: deg) along the horizontal axis.

In the present specification, the X-ray diffraction spectrum of ash shall be measured in a range of a diffraction angle 2θ of 5 to 90° using CuKα radiation as a X-ray source. In the X-ray diffraction spectrum, peaks derived from CaO appear on 2θ=32.24°, 37.40°, 53.93°, 64.24°, 67.47°, 79.77° and 88.66° (PDF card No.: 01-078-0649).

Since preignition occurs in an internal combustion engine having a mean effective pressure of 1.3 MPa or more, an internal combustion engine having a mean effective pressure of 1.3 MPa or more can be benefitted from preignition suppression by the present invention.

In the first embodiment, the internal combustion engine is a gasoline engine equipped with a turbocharger (hereinafter may be referred to as "turbocharged gasoline engine").

In the second embodiment, the internal combustion engine is a premix combustion medium-speed trunk piston diesel engine using a fuel having a flash point of no more than 15° C. as the main fuel.

In the third embodiment, the internal combustion engine is a premix combustion crosshead diesel engine using a fuel having a flash point of no more than 15° C. as the main fuel.

In the present specification, that a premix combustion diesel engine (which may be a medium-speed trunk piston diesel engine or a crosshead diesel engine) uses a fuel having a flash point of no more than 15° C. "as a main fuel" means that the diesel engine compresses a fuel-air mixture of the fuel having a flash point of no more than 15° C. and an air in a cylinder, and thereafter injects a pilot fuel into the cylinder to ignite the fuel-air mixture to burn.

In the second and third embodiments, the method for lubricating an internal combustion engine of the present invention may comprise operating the internal combustion engine using the fuel having a flash point of no more than 15° C. as the main fuel. As the pilot fuel, known diesel fuels (such as heavy oil, light oil and kerosene) may be used without particular limitation as long as it can ignite the fuel-air mixture compressed in the cylinder.

The fuel having a flash point of no more than 15° C. is preferably a fuel comprising a hydrocarbon having a carbon number of 1 to 4, and more preferably a fuel comprising one or more selected from the group consisting of methane, ethane, ethylene, propane, butane, methanol, ethanol and dimethyl ether among $C_{1-4}$ hydrocarbons. Examples of a fuel comprising methane, ethane, propane and/or butane include liquefied natural gas (LNG), compressed natural gas (CNG) and liquefied petroleum gas (LPG).

<Lubricant Base Oil>

At least one selected from a mineral oil and a synthetic oil may be used as a base oil in the lubricating oil composition.

Although not specifically limited, preferred examples of the mineral oil generally include: oils obtained by desulfurizing, hydrocracking, and fractionally distilling atmospheric residue obtained by atmospheric distillation of crude oil, so that the oils have a desired viscosity grade; and oils obtained by solvent-dewaxing or catalytic-dewaxing, and optionally further solvent-extracting and hydrogenating if necessary, the atmospheric residue.

Further examples of the mineral oil include: petroleum wax isomerized lubricant base oils obtained by hydroisomerizing petroleum wax that is side product in a dewaxing process in a base oil production process, which comprises further vacuum distilling the atmospheric distillation residue, fractionally distilling the resultant distillate so as to make the oils have a desired viscosity grade, and thereafter carrying out solvent refining, hydrorefining, etc., and then solvent dewaxing; and GTL wax isomerized lubricant base oils produced by a process of isomerizing GTL WAX (gas to liquid wax) that is produced by a Fischer-Tropsch process, or the like. The basic production processes of these wax isomerized lubricant base oils are the same as those in a method of producing hydrocracked base oils.

Any synthetic oil that is ordinarily used as a lubricant base oil may be used without particular limitations. Specific examples thereof include polybutene and hydrogenated product thereof; poly-α-olefins and hydrogenated product thereof, examples thereof including oligomers of 1-octene, 1-decene, dodecene, etc., or mixture thereof, diesters such as ditridecyl glutarate, bis(2-ethylhexyl) adipate, diisodecyl adipate, ditridecyl adipate, and bis(2-ethylhexyl) sebacate; polyol esters such as trimethylolpropane caprylate, trimethylolpropane pelargonate, pentaerythritol 2-ethylhexanoate, pentaerythritol pelargonate; copolymers of dicarboxylate esters such as dibutyl maleate, and $C_{2-30}$ α-olefins; aromatic synthetic oils such as alkylnaphthalene, alkylbenzene, and aromatic esters; and mixtures thereof.

In the first embodiment, the lubricant base oil may be, for example, a Group I base oil of the API base oil categories, a Group II base oil of the API base oil categories, a Group I base oil of the API base oil categories, a mixture of two or more base oils selected from Groups I to III of the API base oil categories, or a mixture of one or more base oil(s) selected from Groups I to m of the API base oil categories and one or more base oil(s) selected from Groups IV and V of the API base oil categories.

In the second and third embodiments, the lubricant base oil may be, for example, a Group I base oil of the API base oil categories, a Group II base oil of the API base oil categories, or a mixture of Groups I and II base oils of the API base oil categories.

In the first embodiment, the kinematic viscosity of the base oil at 100° C. is preferably 2.5 to 7.5 $mm^2/s$, more preferably no less than 3.5 $mm^2/s$, and more preferably no more than 5.0 $mm^2/s$.

In the second embodiment, the kinematic viscosity of the base oil at 100° C. is preferably 10 to 15 $mm^2/s$, more preferably no less than 12.0 mm/s, and more preferably no more than 14.0 $mm^2/s$.

In the third embodiment, the kinematic viscosity of the base oil at 100° C. is preferably 10 to 20 $mm^2/s$, more preferably no less than 12.5 $mm^2/s$, and more preferably no more than 17.5 $mm^2/s$.

The kinematic viscosity of the base oil of this lower limit or over leads to sufficient oil film formation at positions to be lubricated, which makes it possible to improve lubricity. The kinematic viscosity of the base oil of this upper limit or below leads to improved low-temperature fluidity of the lubricating oil composition, and makes it possible to improve fuel efficiency. In the present description, the kinematic viscosity at 100° C. means a kinematic viscosity at 100° C. specified in ASTM D-445.

In the first embodiment, the viscosity index of the base oil is preferably no less than 100, more preferably no less than 110, and further preferably no less than 120. In the first embodiment, the viscosity index of this lower limit or over makes it possible to not only improve viscosity-temperature characteristics, thermal and oxidation stability, and anti-evaporation property of the lubricating oil composition, but also lower friction coefficient to improve anti-wear properties.

In the second and third embodiments, the viscosity index of the base oil is preferably no less than 85, more preferably no less than 90, and further preferably no less than 95. In the second and third embodiments, the viscosity index of this lower limit or over makes it possible to keep the viscosity low at a low temperature, which leads to good startability.

In the present description, the viscosity index means a viscosity index measured conforming to JIS K 2283-1993.

In the first embodiment, as the lubricant base oil, any one of the following base oils (1) to (3) may be used alone, or a mixed base oil of two or more selected from the following base oils (1) to (3) may be used:

(1) a base oil having a kinematic viscosity at 100° C. of no less than 2.5 $mm^2/s$ and less than 3.5 $mm^2/s$;

(2) a base oil having a kinematic viscosity at 100° C. of no less than 3.5 $mm^2/s$ and less than 5.0 $mm^2/s$; and (3) a base oil having a kinematic viscosity at 100° C. of 5.0 $mm^2/s$ to 12.0 $mm^2/s$.

In the second and third embodiments, the lubricant base oil may be a mixed base oil of a base oil having a kinematic viscosity at 100° C. of 10 to 14 $mm^2/s$ and a base oil having a kinematic viscosity at 100° C. of 20 to 40 $mm^2/s$.

<(A) Metallic Detergent>

The lubricating oil composition comprises a metallic detergent (which may be hereinafter referred to as "component (A)"). The molar ratio B/Ca of the boron content B (unit: mol) of the lubricating oil composition derived from the component (A) and the calcium content Ca (unit: mol) of the lubricating oil composition derived from the component (A) is preferably no less than 0.52, and may be, for example, no less than 0.55. The molar ratio B/Ca of 0.52 or more allows sufficient reduction of CaO in the ash, which makes it possible to effectively suppress preignition. The molar ratio B/Ca is preferably no more than 2.0, and may be, for example, no more than 1.7. The molar ratio B/Ca more than 2.0 deteriorates stability of the component (A).

((A1) Calcium Borate-Containing Carboxylate/Sulfonate Detergent)

The component (A) preferably comprises a calcium borate-containing carboxylate detergent, and/or a calcium borate-containing sulfonate detergent (which may be hereinafter referred to as "component (A1)"). The component (A) comprising calcium borate such that the molar ratio B/Ca of the boron content B (unit: mol) of the lubricating oil composition derived from the component (A) and the calcium content Ca (unit: mol) of the lubricating oil composition derived from the component (A) becomes the above described lower limit or over allows calcium borate to absorb calcium when the lubricating oil composition is incinerated, which allows effective reduction of CaO in ash, which makes it possible to effectively suppress preignition.

As the component (A1), a Ca salicylate detergent overbased with calcium borate, and/or a Ca sulfonate detergent overbased with calcium borate may be preferably employed. The component (A1) preferably comprises a Ca salicylate detergent.

Examples of the Ca salicylate include a compound represented by the following formula (1). A single Ca salicylate may be used alone, or two or more Ca salicylates may be used in combination.

(1)

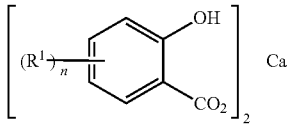

In the formula (1), $R^1$ each independently represents an alkyl or alkenyl group, and n represents 1 or 2. Preferably, n is 1. When n=2, two $R^1$'s may be combination of different groups.

A method for producing the Ca salicylate is not specifically restricted, and for example, a known method for producing monoalkylsalicylates may be employed. For example, the Ca salicylate may be obtained by: making a calcium base such as an oxide and hydroxide of calcium react with a monoalkylsalicylic acid obtained by alkylating a phenol as a starting material with an olefin, and then carboxylating the resultant product with carbonic acid gas or the like, or with a monoalkylsalicylic acid obtained by alkylating a salicylic acid as a starting material with an equivalent of the olefin, or the like; or, converting the above monoalkylsalicylic acid or the like to an alkali metal salt such as a sodium salt and potassium salt, and then performing transmetallation with a calcium salt; or the like.

Examples of the Ca sulfonate detergent include calcium salts of alkyl aromatic sulfonic acids obtained by sulfonation of alkylaromatics, and basic or overbased salts thereof. The weight-average molecular weight of the alkylaromatic is preferably 400 to 1500, and more preferably 700 to 1300. A single Ca sulfonate may be used alone, or two or more Ca sulfonates may be used in combination.

Examples of the alkyl aromatic sulfonic acid include what is called petroleum sulfonic acids and synthetic sulfonic acids. Examples of petroleum sulfonic acids here include sulfonated product of alkylaromatics of lubricant oil fractions derived from mineral oils, and what is called mahogany acid, which is side product of white oils. Examples of synthetic sulfonic acids include sulfonated product of alkylbenzene having a linear or branched alkyl group, obtained by recovering side product in a manufacturing plant of alkylbenzene, which is raw material of detergents, or by alkylating benzene with a polyolefin. Another example of synthetic sulfonic acids is a sulfonated product of alkylnaphthalenes such as dinonylnaphthalene. For example, any sulfonating agent such as a fuming sulfuric acid and a sulfuric anhydride may be used without any limitation, as a sulfonating agent used when sulfonating these alkylaromatics.

A method to obtain a Ca salicylate overbased with calcium borate and/or a Ca sulfonate overbased with calcium borate is not particularly limited. For example, it can be obtained by reacting a Ca salicylate and/or a Ca sulfonate with a calcium base (such as calcium oxide and calcium hydroxide) in the presence of a boric acid and optionally a borate salt. The boric acid may be orthoboric acid, or condensed boric acid (such as diboric acid, triboric acid, tetraboric acid, and metaboric acid). Calcium salts of these boric acids may be preferably used as the borate salt. The borate salt may be a neutral salt, or an acidic salt. As the boric acid and/or borate salt, a single boric acid or borate salt may be used alone, or two or more of them may be used in combination.

The metal ratio of the component (A1) is a value calculated according to the following formula. The metal ratio is preferably no less than 1.3, more preferably no less than 1.5, further preferably no less than 1.7, and especially preferably no less than 2.5; and preferably no more than 7.0, more preferably no more than 5.5, and further preferably no more than 4.0.

Metal ratio of component (*A*1)=2×Ca content of component (*A*1)(mol)/Ca soap group content of component (*A*1)(mol)

When the component (A1) contains two or more Ca soap groups, the "Ca soap group content of component (A1) (mol)" is a sum of molar amounts of respective Ca soap group contained in the component (A1).

The metal ratio of the component (A1) of this lower limit or over makes it possible to improve stability of additives in the lubricating oil composition. The metal ratio of the component (A1) of this upper limit or below makes it possible to improve detergency.

In the first embodiment, the content of the component (A1) in the lubricating oil composition is preferably 0.10 to 0.28 mass % in terms of calcium on the basis of the total mass of the composition.

In the second embodiment, the content of the component (A1) in the lubricating oil composition is preferably 0.25 to 1.20 mass % in terms of calcium on the basis of the total mass of the composition.

In the third embodiment, the content of the component (A1) in the lubricating oil composition is preferably 0.35 to 1.70 mass % in terms of calcium on the basis of the total mass of the composition.

The content of the component (A1) of this lower limit or over makes it easy to improve suppression of preignition as well as makes it possible to have necessary detergency in respective embodiments. The content of the component (A1) of this upper limit or below makes it possible to suppress increase of the ash content in the composition while obtaining preignition suppression effect.

((A2) Calcium Carbonate-Containing Metallic Detergent)

The component (A) preferably comprises a calcium carbonate-containing metallic detergent (which may be hereinafter referred to as "component (A2)"). As the component (A2), a Ca salicylate detergent overbased with calcium carbonate, a Ca sulfonate detergent overbased with calcium carbonate, and/or a Ca phenate detergent overbased with calcium carbonate may be preferably employed. The component (A2) preferably comprises a Ca salicylate detergent.

As the Ca salicylate and the Ca sulfonate, a Ca salicylate and a Ca sulfonate which are the same as explained above in relation to the component (A1) may be employed except that they comprise calcium carbonate instead of calcium borate.

Examples of the Ca phenate include: calcium salts of a compound having a structure represented by the following general formula (2), and basic salts and overbased salts thereof. In the component (A2), one Ca phenate may be used alone, or at least two Ca phenates may be used in combination.

(2)

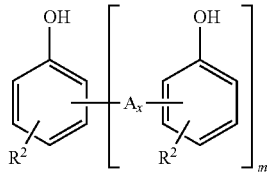

In the formula (2), $R^2$ represents a $C_{6-21}$ linear or branched chain, saturated or unsaturated alkyl or alkenyl group, m represents a polymerization degree, which is an integer of 1 to 10, A represents sulfide (—S—) group or methylene (—$CH_2$—) group, and x represents an integer of 1 to 3. $R^2$ may be combination of at least two different groups.

The carbon number of $R^2$ in the formula (2) is preferably 9 to 18, and more preferably 9 to 15. The carbon number of $R^2$ of this lower limit or over makes it possible to improve solubility of the Ca phenate in the base oil. The carbon number of $R^2$ of this upper limit or below makes it easy to produce the Ca phenate, and makes it possible to improve thermal stability of the Ca phenate.

The polymerization degree m in the formula (2) is preferably 1 to 4. The polymerization degree m within this range makes it possible to improve thermal stability of the Ca phenate.

A method to obtain a Ca salicylate, a Ca sulfonate, and/or a Ca phenate overbased with calcium carbonate is not particularly limited. For example, they can be obtained by reacting, e.g., a Ca salicylate with a calcium base (such as calcium oxide and calcium hydroxide) in the presence of carbon dioxide gas.

The base number of the Ca salicylate detergent overbased with calcium carbonate is preferably 50 to 350 mgKOH/g.

The base number of the Ca sulfonate detergent overbased with calcium carbonate is preferably 10 to 450 mgKOH/g.

The base number of the Ca phenate detergent overbased with calcium carbonate is preferably 50 to 350 mgKOH/g.

The base number of the component (A2) of this lower limit or over makes it possible to improve stability of additives in the lubricating oil composition. The base number of the component (A2) of this upper limit or below makes it easy to improve preignition suppression effect.

In the first embodiment, the content of the component (A2) in the lubricating oil composition is 0.10 to 0.18 mass % in terms of calcium on the basis of the total mass of the composition.

In the second embodiment, the content of the component (A2) in the lubricating oil composition is 0.25 to 0.90 mass % in terms of calcium on the basis of the total mass of the composition.

In the third embodiment, the content of the component (A2) in the lubricating oil composition is 0.35 to 1.30 mass % in terms of calcium on the basis of the total mass of the composition.

The content of the component (A2) of this lower limit or over makes it easy to improve detergency. The content of the component (A2) of this upper limit or below makes it easy to improve preignition suppression effect.

A soap content of a calcium detergent forms CaO when being incinerated. And also, calcium carbonate loses carbon dioxide at a high temperature to form CaO. The component (A) comprising the component (A1), though, allows calcium borate of the component (A1) to capture CaO to form calcium borates of different stoichiometries such as $CaB_2O_4$, $Ca_2B_2O_5$ and $Ca_3(BO_3)_2$, which makes it possible to reduce or suppress CaO formation in ash.

The component (A) may comprise an alkali metal borate. The alkali metal borate may be an alkali metal salt of orthoboric acid, or an alkali metal salt of condensed boric acid (such as diboric acid, triboric acid, tetraboric acid, and metaboric acid). Examples of alkali metal salts include sodium salts and potassium salts. Alkali metal borates, however, tend to deposit on an exhaust gas turbine of a turbocharger as ash, and thus may lead to surging of the exhaust gas turbine or distortion of a turbine shaft. Thus, the alkali metal borate content in the lubricating oil composition is preferably less than 0.05 mass %, more preferably less than 0.01 mass %, and especially preferably less than 0.005 mass %, and may be even 0 mass % (i.e., the lubricating oil composition does not comprise any alkali metal borate), in terms of alkali metal content on the basis of the total mass of the composition.

The component (A) may comprise a magnesium detergent and/or magnesium borate. A magnesium content, however, may lead to deposition of hard magnesium-based ash such as $MgCO_3$ and MgO on a piston surface, or to formation of needle crystals by reaction with water formed by combustion, which then may lead to fouling of an oil filter. Thus, the magnesium content in the lubricating oil composition is preferably less than 0.05 mass %, and may be even 0 mass % (i.e., the lubricating oil composition does not comprise any magnesium content) on the basis of the total mass of the composition.

<(B) Ashless Dispersant>

The lubricating oil composition preferably comprises an ashless dispersant (which may be hereinafter referred to as "component (B)"). As the ashless dispersant, succinimide having at least one alkyl or alkenyl group in its molecule, or a boronated derivatives thereof may be preferably used.

Examples of succinimide having at least one alkyl or alkenyl group in its molecule include a compound represented by the following general formula (3) or (4):

(3)

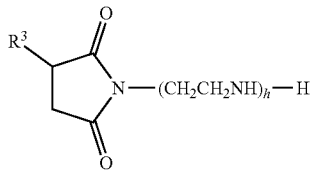

(4)

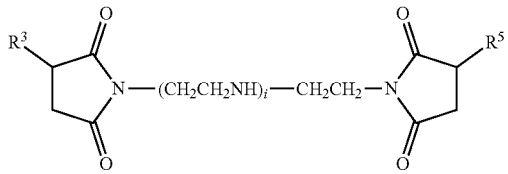

In the formula (3), $R^3$ represents a $C_{40-400}$ alkyl or alkenyl group, h is an integer of 1 to 5, which is preferably 2 to 4. The carbon number of $R^3$ is preferably no less than 60, and preferably no more than 350.

In the formula (4), $R^4$ and $R^5$ each independently represents a $C_{40-400}$ alkyl or alkenyl group, and may be combination of different groups. $R^4$ and $R^5$ are especially preferably polybutenyl groups. "i" represents an integer of 0 to 4, which is preferably 1 to 3. Carbon numbers of $R^4$ and $R^5$ are preferably no less than 60, and preferably no more than 350.

Succinimide having at least one alkyl or alkenyl group in its molecule includes so-called monotype succinimide represented by the formula (3), where a succinic anhydride terminates only one end of a polyamine chain, and so-called bis-type succinimide represented by the formula (4), where succinic anhydrides terminate both ends of a polyamine chain. The lubricating oil composition of the present invention may contain any of monotype and bis-type succinimide, and may contain both of them as a mixture. In the component (B), the main component is preferably bis-type succinimide. That is, the content of bis-type succinimide (formula (4)) is preferably more than 50 mass %, more preferably no less than 70 mass %, further preferably no less than 80 mass %, and may be even 100 mass %, on the basis of the total mass of the component (B) (100 mass %).

A production method of the succinimide having at least one alkyl or alkenyl group in its molecule is not particularly limited. For example, it can be obtained by: reacting a compound having a $C_{40}$-$C_{400}$ alkyl or alkenyl group with maleic anhydride at 100 to 200° C. to obtain an alkyl or alkenyl succinic acid; and reacting the alkyl or alkenyl succinic acid with a polyamine. Here, examples of a polyamine include diethylenetriamine, triethylenetetramine, tetraethylenepentamine, and pentaethylenehexamine.

Examples of the boronated derivatives of succinimide having at least one alkyl or alkenyl group in its molecule include so-called boron-modified compounds where a part or all of the residual amino and/or imino groups are neutralized or amidated by making boric acid react with the above described succinimide having at least one alkyl or alkenyl group in its molecule.

When the component (B) comprises boron, the mass ratio (B/N ratio) of the boron content in the component (B) and the nitrogen content in the component (B) is preferably 0.2 to 1, and more preferably 0.25 to 0.5. A higher B/N ratio makes it easier to improve anti-wear property and anti-seizure property. The B/N ratio of 1 or less can lead to improved stability.

The weight average molecular weight (Mw) of the component (B) is not particularly limited, and is preferably 1000 to 20000, more preferably no less than 2500, further preferably no less than 4000, and especially preferably no less than 5000. The weight average molecular weight of the ashless dispersant of this lower limit or over makes it easy to suppress deposition of deposits, and is also advantageous in suppressing wear. The weight average molecular weight of the ashless dispersant of this upper limit or below makes it possible to have sufficient fluidity of the lubricating oil composition, and makes it easy to suppress increase of deposits.

The content of component (B) in the lubricating oil composition is preferably 0.10 to 0.15 mass %, and more preferably no less than 0.03 mass %; and more preferably no more than 0.1 mass %, and further preferably no more than 0.07 mass %, in terms of nitrogen on the basis of the total mass of the composition. The content of the component (B) of this lower limit or over makes it easy to improve anti-coking property (thermal stability) by finely dispersing, e.g., deterioration products and soot. The content of the component (B) over this upper limit may lead to coking of thermal deterioration products of the component (B), which may deteriorate high-temperature detergency.

When the component (B) comprises boron, the content of the component (B) in the lubricating oil composition as boron is preferably 0.01 to 0.1 mass %, more preferably 0.005 to 0.05 mass %, and especially preferably 0.01 to 0.04 mass %, in terms of boron on the basis of the total mass of the composition. The content of boron derived from the component (B) within this range makes it easy to improve fuel efficiency.

<(C) Phosphorus-Containing Anti-Wear Agent>

The lubricating oil composition preferably comprises a phosphorus-containing anti-wear agent (which may be hereinafter referred to as "component (C)"). Examples of the component (C) include a phosphorus compound represented by the following general formula (5), a phosphorus compound represented by the following general formula (6), and metal salts and amine salts thereof.

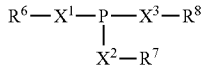

(5)

(In the formula (5), $X^1$, $X^2$ and $X^3$ each independently represents an oxygen atom or a sulfur atom, and one or two of $X^1$, $X^2$ and $X^3$ may be an oxyalkylene group or polyoxyalkylene group, or a single bond. $R^6$, $R^7$ and $R^6$ each independently represents a hydrogen atom or a $C_{1-30}$ hydrocarbon group.)

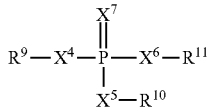

(6)

(In the formula (6), $X^4$, $X^5$, $X^6$ and $X^7$ each independently represents an oxygen atom or a sulfur atom, and one or two of $X^4$, $X^5$ and $X^6$ may be oxyalkylene group or polyoxyalkylene group, or a single bond. $R^9$, $R^{10}$ and $R^{11}$ each independently represents a hydrogen atom or a $C_{1-30}$ hydrocarbon group.)

Examples of a $C_{1-30}$ hydrocarbon group include an alkyl group, a cycloalkyl group, an alkenyl group, an alkyl-substituted cycloalkyl group, an aryl group, an alkyl-substituted aryl group, and an arylalkyl group. $R^6$ to $R^{11}$ are preferably $C_{1-30}$ alkyl or $C_{6-24}$ aryl groups, more preferably $C_{3-18}$ alkyl groups, and further preferably $C_{4-12}$ alkyl groups.

Examples of metal in metal salts of a phosphorus compound represented by the general formula (5) or (6) include alkali metals such as lithium, sodium, potassium and cesium, alkaline earth metals such as calcium, magnesium and barium, and heavy metals such as zinc, copper, iron, lead, nickel, silver and manganese. Among them, alkaline earth metals such as calcium and magnesium, and zinc are preferable, and zinc is especially preferable.

Examples of amines in amine salts of a phosphorus compound represented by the general formula (5) or (6) include ammonia, monoamines, diamines, polyamines and alkanolamines. More specific examples thereof include monoamines having a $C_{1-30}$ preferably $C_{1-18}$ linear or branched chain alkyl or alkenyl group; alkanolamines having a $C_{1-30}$, preferably $C_{1-4}$ linear or branched chain hydroxyalkyl group; alkylene diamine having a $C_{1-30}$, preferably $C_{1-4}$ alkylene group; and polyamines such as diethylenetriamine, triethylenetetramine, tetraethylenepentamine, and pentaethylenehexamine. Further examples include: compounds having a C8-20 alkyl or alkenyl group on a nitrogen atom of a monoamine, diamine, polyamine, or alkanolamine; heterocyclic compounds such as imidazoline; alkyleneoxide adducts of these compounds; and mixtures thereof. Among these amine compounds, primary or secondary monoamines, and primary or secondary alkanolamines are preferable.

Among these amine compounds, aliphatic amines having a $C_{10-20}$ linear or branched chain alkyl or alkenyl group such as decylamine, dodecylamine, dimethyldodecylamine, tridecylamine, heptadecylamine, octadecylamine, oleylamine and stearylamine are especially preferable.

As the component (C), at least one selected from the following (C1) to (C3) may be especially preferably employed:

(C1) zinc dialkyl dithiophosphate having $C_{3-8}$ primary alkyl groups (which may be hereinafter referred to as "component (C1)");

(C2) zinc dialkyl dithiophosphate having $C_{3-8}$ secondary alkyl groups (which may be hereinafter referred to as "component (C2)"); and (C3) a metal salt of sulfur-free phosphorus-containing acid, preferably a zinc salt (which may be hereinafter referred to as "component (C3)").

One of them may be used alone, or two or more of them may be used in combination.

Examples of the components (C1) and (C2) include a compound represented by the following general formula (7):

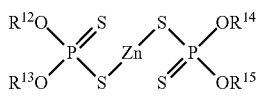

(7)

(In the formula (7), $R^{12}$, $R^{13}$, $R^{14}$ and $R^{15}$ each independently represents a $C_{3-8}$ primary or secondary alkyl group, and may be combination of different groups.)

Examples of the component (C3) include: a metal salt of a phosphorus compound of the general formula (5) wherein all of $X^1$ to $X^3$ are oxygen atoms (wherein one or two of $X^1$, $X^2$ and $X^3$ may be an oxyalkylene group(s) or polyoxyalkylene group(s) or a single bond(s)); and a metal salt of a phosphorus compound of the general formula (6) wherein all of $X^4$ to $X^7$ are oxygen atoms (wherein one or two of $X^4$, $X^5$ and $X^6$ may be an oxyalkylene group(s) or polyoxyalkylene group(s) or a single bond(s)).

Preferred examples of the component (C3) include: zinc salts of phosphorous acid diesters having two $C_{3-18}$ alkyl or aryl groups; zinc salts of monoesters of diesters of phosphoric acid having one or two $C_{3-18}$ alkyl or aryl group(s); and zinc salts of phosphonic acid monoesters having two $C_{1-18}$ alkyl or aryl groups. Among them, zinc salts of phosphate esters having one or two $C_{4-12}$ alkyl group(s) are especially preferable.

In the first embodiment, as the component (C), the component (C1) and/or the component (C2) may be preferably used, and the component (C2) may be especially preferably used.

In the second and the third embodiments, as the component (C), the component (C1) and/or the component (C2) may be preferably used, and the component (C1) may be especially preferably used.

In the first embodiment, the content of the component (C) in the lubricant oil composition is 400 to 850 mass ppm in terms of phosphorous on the basis of the total mass of the composition.

In the second embodiment, the content of the component (C) in the lubricant oil composition is 400 to 1200 mass ppm in terms of phosphorous on the basis of the total mass of the composition.

In the third embodiment, the content of the component (C) in the lubricant oil composition is 100 to 700 mass ppm in terms of phosphorous on the basis of the total mass of the composition.

The content of the component (C) of this lower limit or over makes it possible to improve anti-wear property. The content of the component (C) of this upper limit or below makes it possible to improve high temperature detergency and base number retention property.

<(D) Amine Antioxidant>

The lubricating oil composition preferably comprises an amine antioxidant (which may be hereinafter simply referred to as "component (D)").

Preferred examples of the component (D) include alkylated diphenylamine, alkylated phenyl-α-naphthylamine, phenyl-α-naphthylamine and phenyl-β-naphthylamine. As the component (D), one of them may be used alone, or two or more of them may be used in combination.

The content of the component (D) in the lubricating oil composition is preferably 0.01 to 0.1 mass % in terms of nitrogen on the basis of the total mass of the composition. The content of the component (D) of this lower limit or over makes it possible to improve preignition suppression effect. The content of the component (D) of this upper limit or below makes it possible to improve dissolution stability of additives in the lubricating oil composition while obtaining preignition suppression effect.

<(E) Oil-Soluble Organic Molybdenum Compound)

The lubricating oil composition preferably comprises an oil-soluble organic molybdenum compound (which may be hereinafter simply referred to as "component (E)"). An oil-soluble organic molybdenum compound may be a sulfur-containing oil-soluble organic molybdenum compound, or a sulfur-free oil-soluble organic molybdenum compound. Examples of a sulfur-containing oil-soluble organic molybdenum compound include molybdenum dithiophosphate (MoDTP), molybdenum dithiocarbamate (MoDTC); complexes of molybdenum compounds (examples thereof include: molybdenum oxides such as molybdenum dioxide and molybdenum trioxide; molybdenum acids such as orthomolybdic acid, paramolybdic acid, and sulfurized (poly) molybdic acid; molybdic acid salts such as metal salts and ammonium salts of these molybdic acids; molybdenum sulfides such as molybdenum disulfide, molybdenum trisulfide, molybdenum pentasulfide, and molybdenum polysulfide; thiomolybdic acid; metal salts and amine salts of thiomolybdic acid; and molybdenum halides such as molybdenum chloride), and sulfur-containing organic compounds (examples thereof include: alkyl (thio)xanthate, thiadiazole, mercaptothiadiazole, thiocarbonate, tetrahydrocarbylthiuram disulfide, bis(di(thio)hydrocarbyldithiophosphonate) disulfide, organic (poly)sulfide, and sulfurized ester); and complexes of sulfur-containing molybdenum compounds such as the above described molybdenum sulfides and sulfurized molybdic acids, and alkenylsuccinimide.

Examples of a sulfur-free oil-soluble molybdenum compound include molybdenum-amine complex, molybdenum-succinimide complex, molybdenum salt of organic acids, and molybdenum salt of alcohols.

Preferred examples of the component (E) include molybdenum dithiocarbamate (MoDTC), molybdenum dithiophosphate (MoDTP), molybdenum polyisobutenylsuccinimide complex, and dialkylamine salt of molybdic acids. One or at least two selected from them may be preferably used. Among them, MoDTC and/or MoDTP are/is preferable, and MoDTC is especially preferable.

For example, a compound represented by the following general formula (8) may be used as molybdenum dithiocarbamate (MoDTC):

(8)

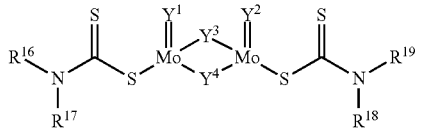

In the formula (8), $R^{16}$ to $R^{19}$ each independently represents a $C_{2-24}$ alkyl or $C_{6-24}$ (alkyl)aryl group, and preferably a $C_{4-13}$ alkyl or $C_{10-15}$ (alkyl)aryl group. $R^{16}$ to $R^{19}$ may be combination of different groups. The alkyl group may be a primary, secondary, or tertiary alkyl group, and may be linear or branched. "(Alkyl)aryl group" means "aryl group or alkylaryl group". An alkylaryl group may have an alkyl group in any position of an aromatic ring. $Y^1$ to $Y^4$ are each independently a sulfur atom or oxygen atom.

For example, a compound represented by the following general formula (9) may be used as molybdenum dithiophosphate:

(9)

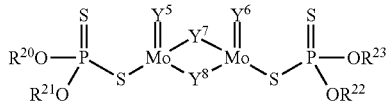

In the formula (9), $R^{20}$ to $R^{23}$ each independently represents a $C_{2-30}$ alkyl or $C_{6-18}$ (alkyl)aryl group, and may be combination of different groups. The carbon number of the alkyl group is preferably 5 to 18, and more preferably 5 to 12. The carbon number of the (alkyl)aryl group is preferably 10 to 15. $Y^5$ to $Y^8$ are each independently a sulfur atom or oxygen atom. The alkyl group may be a primary, secondary, or tertiary alkyl group, and may be linear or branched. An alkylaryl group may have an alkyl group in any position of an aromatic ring.

The content of the component (E) in the lubricating oil composition is preferably 400 to 1000 mass ppm, and more preferably no less than 600 mass ppm; and more preferably no more than 900 mass ppm, further preferably no more than 850 mass ppm, and especially preferably no more than 800 mass ppm, in terms of molybdenum on the basis of the total mass of the composition. The content of the component (E) of this lower limit or over makes it possible to improve friction reducing effect. The content of the component (E) of this upper limit or below makes it possible to suppress the ash content in the lubricating oil composition, and to improve the storage stability of the lubricating oil composition.

The component (C) and the component (E) contribute to further reduction of CaO formation in ash by forming calcium salts when the lubricating oil composition is incinerated. Therefore, the lubricating oil composition preferably comprises the component (C) and/or the component (E), and especially preferably comprises the component (C) and the component (E) in combination.

For example, a lubricating oil composition comprising a zinc dithiophosphate and/or a zinc phosphate (such as the components (C1) to (C3)) as the component (C) can further reduce CaO formation in ash because the component (C) can react with calcium to form a calcium salt such as $Ca_{10}(PO_4)_6(OH)_2$ and $Ca_5(PO_4)_3(OH)$ when the lubricating oil composition is incinerated.

For another example, a lubricating oil composition comprising MoDTC as the component (E) can further reduce CaO formation in ash because the component (E) can react with calcium to form a calcium salt such as $CaMoO_4$ when the lubricating oil composition is incinerated.

For another example, a lubricating oil composition comprising a zinc dithiophosphate as the component (C) and MoDTC as the component (E) can further reduce CaO formation in ash because the components (C) and (E) can react with calcium to form a calcium salt such as $Ca_{19}Zn_2(PO_4)_{14}$, $CaZn_2(PO_4)_2$ and $CaMO_4$ when the lubricating oil composition is incinerated.

<Other Additives>

The lubricating oil composition of the present invention may further comprise any additive that is generally used for lubricating oils according to purposes thereof. Examples of such an additive include a viscosity index improver, an antioxidant other than the components (C) and (D), a friction modifier other than the component (E), an antiwear or extreme pressure agent other than the components (C) and (E), a pour point depressant, an anti-rust agent, a metal deactivator, a demulsifier and a defoaming agent.

Examples of a viscosity index improver include non-dispersant or dispersant poly(meth)acrylate viscosity index improvers, (meth)acrylate-olefin copolymers, non-dispersant or dispersant ethylene-α-olefin copolymers or hydrogenated products thereof, polyisobutylene or hydrogenated products thereof, hydrogenated styrene-diene copolymers, styrene-maleic anhydride/ester copolymers, and polyalkylstyrene. The weight-average molecular weight of the viscosity index improver is usually 5,000 to 1,000,000, and preferably 100,000 to 900,000. When the lubricating oil composition comprises the viscosity index improver, the content thereof is normally 0.1 to 20 mass % on the basis of the total mass of the composition.

Examples of an antioxidant other than the components (C) and (D) include known ashless antioxidants such as phenol-based antioxidants (for example, 2,6-di-tert-butyl-4-methylphenol (DBPC), and 4,4'-methylenebis(2,6-di-tert-butylphenol)). When the lubricating oil composition comprises the antioxidant other than the components (C) and (D), the content thereof is normally 0.1 to 5 mass % on the basis of the total mass of the composition.

Examples of a friction modifier other than the component (E) include ashless friction modifiers of fatty acid esters, fatty amines, and fatty acid amides. When the lubricating oil composition comprises the friction modifier other than the component (E), the content thereof is usually 0.01 to 5 mass % on the basis of the total mass of the composition.

Examples of an antiwear or extreme pressure agent other than the components (C) and (E) include sulfur-based extreme pressure agents. Specific examples thereof include dithiocarbamate, zinc dithiocarbamate, disulfides, polysulfides, sulfurized olefins, and sulfurized fats. When the lubricating oil composition comprises an extreme pressure agent, the content thereof is usually 0.01 to 5 mass % on the basis of the total mass of the composition.

Examples of a pour point depressant include polymethacrylate polymers which are suitable for the lubricant base oil employed. When the lubricating oil composition comprises the pour point depressant, the content thereof is usually 0.005 to 5 mass % on the basis of the total mass of the composition.

Examples of an anti-rust agent include known anti-rust agents such as petroleum sulfonate, alkylbenzenesulfonate, dinonylnaphthalenesulfonate, alkenylsuccinate esters, and polyol esters without any limitation. When the lubricating oil composition comprises the anti-rust agent, the content thereof is usually 0.005 to 5 mass % on the basis of the total mass of the composition.

Examples of a metal deactivator include imidazoline, pyrimidine derivatives, alkylthiadiazole, mercaptobenzothiazole, benzotriazole or derivatives thereof, 1,3,4-thiadiazole polysulfide, 1,3,4-thiadiazolyl-2,5-bisdialkyldithiocarbamate, 2-(alkyldithio)benzimidazole, and β-(o-carboxybenzylthio)propionitrile. When the lubricating oil composition comprises the metal deactivator, the content thereof is usually 0.005 to 1 mass % on the basis of the total mass of the composition.

Examples of a demulsifier include known demulsifiers such as polyoxyalkylene glycol-based nonionic surfactants including polyoxyethylene alkyl ether, polyoxyethylene alkyiphenyl ether, and polyoxyethylene alkylnaphthyl ether without any limitation. When the lubricating oil composition comprises the demulsifier, the content thereof is usually 0.005 to 5 mass % on the basis of the total mass of the composition.

Examples of a defoaming agent include known defoaming agents such as silicone, fluorosilicones, and fluoroalkyl ethers without any limitation. When the lubricating oil composition comprises the defoaming agent, the content thereof is unusually 0.0005 to 1 mass % on the basis of the total mass of the composition.

<Lubricating Oil Composition for Internal Combustion Engine>

In the first embodiment, the kinematic viscosity of the lubricating oil composition at 100° C. is preferably 4.0 to 12 $mm^2/s$, more preferably no more than 9.3 $mm^2/s$, further preferably no more than 8.2 $mm^2/s$, especially preferably no more than 7.1 $mm^2/s$, and most preferably no more than 6.8 $mm^2/s$; and more preferably no less than 5.0 $mm^2/s$, further preferably no less than 5.5 $mm^2/s$, especially preferably no less than 6.1 $mm^2/s$, and most preferably no less than 6.3 $mm^2/s$. The kinematic viscosity of the lubricating oil composition at 100° C. of this lower limit or over makes it easy to improve lubricity. The kinematic viscosity of the lubricating oil composition at 100° C. of this upper limit or below makes it easy to improve low-temperature viscosity characteristics and fuel efficiency.

In the first embodiment, the kinematic viscosity of the lubricating oil composition at 40° C. is preferably 4.0 to 50 $mm^2/s$, more preferably no more than 40 $mm^2/s$, further preferably no more than 35 $mm^2/s$, further more preferably no more than 32 $mm^2/s$, especially preferably no more than 30 $mm^2/s$, and most preferably no more than 28 $mm^2/s$; and more preferably no less than 15 $mm^2/s$, further preferably no less than 18 $mm^2/s$, further more preferably no less than 20 $mm^2/s$, especially preferably no less than 22 $mm^2/s$, and most preferably no less than 25 $mm^2/s$. The kinematic viscosity of the lubricating oil composition at 40° C. of this lower limit or over makes it easy to improve lubricity. The kinematic viscosity of the lubricating oil composition at 40° C. of this upper limit or below makes it easy to improve low-temperature viscosity characteristics and fuel efficiency.

In the first embodiment, the viscosity index of the lubricating oil composition is preferably 140 to 400, more preferably no less than 160, further preferably no less than 180, especially preferably no less than 200, and most preferably no less than 210. The viscosity index of the lubricating oil composition of this lower limit or over makes it easy to improve fuel efficiency while maintaining HTHS viscosity at 150° C. as well as to reduce viscosity at low temperature (such as −35° C., which is a measurement temperature of CCS viscosity defined in SAE viscosity grade 0W-X known as a viscosity grade of fuel economy oil). The viscosity index of the lubricating oil composition of this upper limit or below makes it easy to reduce evaporation loss as well as to improve solubility of additives and seal suitability.

In the second embodiment, the kinematic viscosity of the lubricating oil composition at 100° C. is preferably 9.3 to 16.3 $mm^2/s$, more preferably 10.0 to 15.5 $mm^2/s$, and further preferably 13.0 to 15.5 $mm^2/s$. The kinematic viscosity of the lubricating oil composition at 100° C. of this lower limit or over makes it easy to have sufficient oil film thickness and oil pressure necessary for reliability of middle speed diesel engines. The kinematic viscosity of the lubricating oil composition at 100° C. of this upper limit or below makes it easy to improve low-temperature viscosity characteristics and fuel efficiency.

In the third embodiment, the kinematic viscosity of the lubricating oil composition at 100° C. is preferably 16.3 to 21.9 $mm^2/s$, and more preferably 18.0 to 21.9 $mm^2/s$. The kinematic viscosity of the lubricating oil composition at 100° C. of this lower limit or over makes it easy to improve lubricity. The kinematic viscosity of the lubricating oil composition at 100° C. of this upper limit or below makes it easy to improve low-temperature startability.

In the first embodiment, the calcium content in the lubricating oil composition is preferably 0.16 to 0.28 mass % on the basis of the total mass of the composition.

In the second embodiment, the calcium content in the lubricating oil composition is preferably 0.45 to 1.20 mass % on the basis of the total mass of the composition.

In the third embodiment, the calcium content in the lubricating oil composition is preferably 0.53 to 1.60 mass % on the basis of the total mass of the composition.

The calcium content in the lubricating oil composition of this lower limit or over makes it possible to have detergency necessary for respective embodiments. The calcium content in the lubricating oil composition of this upper limit or below makes it easy to reduce integrated intensity of peaks of CaO in a X-ray diffraction spectrum of ash.

In the second embodiment, the base number of the lubricating oil composition is preferably 15.0 to 35.0 mgKOH/g.

In the third embodiment, the base number of the lubricating oil composition is preferably 15.0 to 45.0 mgKOH/g.

The base number of the lubricating oil composition of this lower limit or over makes it possible to have detergency necessary for respective embodiments. The base number of the lubricating oil composition of this upper limit or below makes it possible to suppress bore polishing and scuffing caused by deposition of an excess base content on a piston. In the present specification, the base number means a base number measured by the perchloric acid method conforming to JIS K2501.

EXAMPLES

Hereinafter the present invention will be more specifically described based on Examples and Comparative Examples. The present invention is not limited to these examples.

Examples 1 to 12 and Comparative Examples 1 to 14

Prepared were lubricating oil compositions for turbocharged gasoline engines (Examples 1 to 5 and Comparative Examples 1 to 6, Table 1), lubricating oil compositions for premix combustion medium-speed trunk piston diesel engines (Examples 6 to 9 and Comparative Examples 7 to 10, Table 2) and PCTI/JP2017/037722 lubricating oil compositions for cylinders for premix combustion crosshead diesel engines (Examples 10 to 12 and Comparative Examples 11 to 14, Table 3) which had formulations shown in Tables 1 to 3. In Tables 1 to 3, a content of a base oil is on the basis of the mass of the total base oils, and a content other than base oils is on the basis of the total mass of the composition.

(Base oil)

Base oil 1: Group III base oil of the API base oil categories, kinematic viscosity (100° C.): 4.15 $mm^2/s$, sulfur content: no more than 1 mass ppm, aromatic content: 0.2 mass %, viscosity index: 123

Base oil 2: Group I base oil of the API base oil categories, kinematic viscosity (100° C.): 10.8 $mm^2/s$, sulfur content: 0.6 mass %, aromatic content: 37.3 mass %, viscosity index: 97

Base oil 3: Group I base oil of the API base oil categories, kinematic viscosity (100° C.): 31.7 $mm^2/s$, sulfur content 0.5 mass %, aromatic content 36.7 mass %, viscosity index: 96

(Component (A1): Calcium Borate-Containing Carboxylate/Sulfonate)

A1-1: calcium borate-containing Ca salicylate (base number: 190 mgKOH/g, metal ratio: 3.5, Ca content: 7.0 mass %, B content: 2.7 mass %, S content: 0.2 mass %)

A1-2: calcium borate-containing Ca sulfonate (base number. 180 mgKOH/g, metal ratio: 10.0, Ca content: 7.7 mass %, B content: 3.8 mass %, S content 0.2 mass %)

(Component (A2): calcium carbonate-containing metallic detergent)

A2-1: calcium carbonate-containing Ca salicylate (base number: 170 mgKOH/g, metal ratio: 3.3, Ca content 6.3 mass %, S content 0.2 mass %)

A2-2: calcium carbonate-containing Ca sulfonate (base number 320 mgKOH/g, metal ratio: 10.0, Ca content 11.0 mass %, S content: 2.2 mass %)

A2-3: calcium carbonate-containing Ca phenate (base number 250 mgKOH/g, metal ratio: 3.5, Ca content: 9.25 mass %, S content: 3.5 mass %)

(Component (A3): Other Metallic Detergents)

A3-1: magnesium carbonate-containing Mg sulfonate (base number: 405 mgKOH/g, metal ratio: 9.7, Mg content 9.1 mass %)

(Component (B): Ashless Dispersant)

B-1: polybutenyl succinimide, bistype, number average molecular weight of the polybutenyl group: 1300, N content: 1.75 mass %

B-2: boric acid-modified polybutenyl succinimide, bistype, number average molecular weight of the polybutenyl group: 1300, N content 1.5 mass %, B content: 0.78 mass %

(Component (C): Phosphorus-Containing Anti-Wear Agent)

C-1: secondary ZnDTP (P content 8.5 mass %, Zn content 9.25 mass %, S content 17.6 mass %, alkyl group: $C_3$ or $C_6$ secondary alkyl group)

C-2: primary ZnDTP (P content: 7.4 mass %, Zn content 9.0 mass %, S content 15.0 mass %, alkyl group: Ca primary alkyl group (2-ethylhexyl group))

(Component (D): Amine Antioxidant)

D-1: alkyl diphenylamine (reaction product of diphenylamine and 2,4,4-trimethylpentene)

(Component (E): Oil-Soluble Organic Molybdenum Compound)

E-1: sulfurized (oxy)molybdenum dithiocarbamate, alkyl group: combination of $C_8$ alkyl group and $C_{13}$ alkyl group, Mo content: 10.0 mass %, S content 10.8 mass %

(Other Additives)

Viscosity index improver: polymethacrylate viscosity index improver, weight average molecular weight: 500,000, PSSI: 5

Pour point depressant: polyalkyl methacrylate

Defoaming agent: polydimethylsiloxane (kinematic viscosity (25° C.): 60,000 $mm^2/s$)

<Evaluation Method>

(Incineration of lubricating oil)

Sample oil (12 g) was placed in a 60 mL crucible, and the sample oil was incinerated in an air by heating from room temperature to 950° C. at a heating rate of 20° C./min, and then kept at 950° C. for 1 hour, using an electric muffle furnace (FUL252FA manufactured by Advantec Toyo Kaisha, Ltd.). After completion of the incineration, the crucible was allowed to cool to room temperature in a desiccator.

(Carbonation Test)

Concerning each lubricating oil composition, using a pressure differential scanning calorimeter (PDSC, Q2000DSC manufactured by TA Instruments), the ash (3 mg) obtained by the incineration described above was heated from room temperature to 550° C. at a heating rate of 10° C./min in a carbon dioxide atmosphere (1.0 MPa), and released heat was measured. The results are shown in Tables 1 to 3. Less released heat in this test means more suppression of preignition derived from reaction heat of a reaction of ash scattered in a cylinder and carbon dioxide in a cylinder atmosphere.

(Powder X-Ray Diffraction Analysis)

Concerning each lubricating oil composition, the ash obtained by the above-described incineration was analyzed by powder X-ray diffraction. The measurement conditions of the powder X-ray diffraction were as follows:

X-ray diffractometer: RINT2500 (manufactured by Rigaku Corporation)

X-ray source: CuKα radiation (using a monochromator)

Tube voltage: 50 kV

Tube current: 200 mA

Divergence slit: 0.5 deg

Diffraction slit: 0.5 deg

Receiving slit: 0.15 mm

Diffraction angle 2θ: 5 to 90 deg

An obtained X-ray diffraction spectrum (horizontal axis: diffraction angle 2θ (unit: deg), vertical axis: diffracted X-ray intensity (unit: cps)) was analyzed using PDXL (analysis software manufactured by Rigaku Corporation), and thus a ratio of total integrated intensity of all peaks derived from CaO (2θ=32.24°, 37.40° (main peak), 53.93°, 64.24°, 67.47°, 79.77° and 88.66°) to total integrated intensity of all peaks in the spectrum was calculated. The results are shown in Table 1 to 3. A smaller integrated intensity ratio of peaks of CaO means a smaller CaO content in the ash.

TABLE 1

| | | Examples | | | | | Comparative examples | | | | | |
|---|---|---|---|---|---|---|---|---|---|---|---|---|
| | | 1 | 2 | 3 | 4 | 5 | 1 | 2 | 3 | 4 | 5 | 6 |
| Base oil | | | | | | | | | | | | |
| Base oil 1 | mass % | 100 | 100 | 100 | 100 | 100 | 100 | 100 | 100 | 100 | 100 | 100 |
| Component (A1) | | | | | | | | | | | | |
| A1-1 | mass % | 2.86 | 2.86 | 1.14 | 1.14 | — | 1.00 | — | — | — | — | — |
| A1-2 | mass % | — | — | — | — | 1.04 | — | — | — | — | — | — |
| (in terms of B) | mass ppm | 771 | 771 | 309 | 309 | 395 | 270 | 0 | 0 | 0 | 0 | 0 |
| (in terms of Ca) | mass ppm | 2000 | 2000 | 800 | 800 | 800 | 700 | 0 | 0 | 0 | 0 | 0 |
| Component (A2) | | | | | | | | | | | | |
| A2-1 | mass % | — | — | 1.90 | 1.90 | — | 2.06 | 3.17 | — | — | — | 1.90 |
| A2-2 | mass % | — | — | — | — | 1.09 | — | — | 1.82 | — | 0.90 | — |
| A2-3 | mass % | — | — | — | — | — | — | — | — | 2.16 | — | — |
| (in terms of Ca) | mass ppm | 0 | 0 | 1200 | 1200 | 1200 | 1300 | 2000 | 2000 | 2000 | 1000 | 2000 |
| Component (A3) | | | | | | | | | | | | |
| A3-1 | mass % | — | — | — | — | — | — | — | — | — | 0.90 | — |
| (in terms of Mg) | mass ppm | 0 | 0 | 0 | 0 | 0 | 0 | 0 | 0 | 0 | 820 | 0 |
| Component (B) | | | | | | | | | | | | |
| B-1 | mass % | — | 3.30 | — | 3.30 | — | — | — | — | — | — | — |
| B-2 | mass % | — | — | — | — | — | — | — | — | — | — | 4.00 |
| C-1 | mass % | — | 0.82 | — | 0.82 | — | — | — | — | — | — | — |
| D-1 | mass % | — | 1.00 | — | 1.00 | — | — | — | — | — | — | — |
| E-1 | mass % | — | 0.70 | — | 0.70 | — | — | — | — | — | — | — |
| Viscosity index improver | mass % | — | 6.00 | — | 6.00 | — | — | — | — | — | — | — |
| Pour point depressant | mass % | — | 0.30 | — | 0.30 | — | — | — | — | — | — | — |
| Defoaming agent | mass % | — | 0.002 | — | 0.002 | — | — | — | — | — | — | — |
| Kinematic viscosity (100° C.) | $mm^2/s$ | 5.3 | 6.5 | 5.3 | 6.5 | 5.3 | 5.3 | 5.3 | 5.3 | 5.3 | 5.3 | 6.1 |
| B/Ca molar ratio | | 1.43 | 1.43 | 0.57 | 0.57 | 0.73 | 0.50 | 0.00 | 0.00 | 0.00 | 0.00 | 0.00 |
| CaO integrated intensity ratio | % | 0.0 | 0.0 | 14.9 | 0.0 | 5.5 | 17.4 | 97.2 | 75.8 | 62.6 | 45.0 | 40.1 |
| Released heat in carbonation test | J/g | 0 | 0 | 0 | 0 | 0 | 311 | 1376 | 443 | 243 | 356 | 660 |

TABLE 2

| | | Examples | | | | Comparative examples | | | |
|---|---|---|---|---|---|---|---|---|---|
| | | 6 | 7 | 8 | 9 | 7 | 8 | 9 | 10 |
| Base oil | | | | | | | | | |
| Base oil 2 | mass % | 79 | 79 | 79 | 79 | 79 | 79 | 79 | 79 |
| Base oil 3 | mass % | 21 | 21 | 21 | 21 | 21 | 21 | 21 | 21 |
| Component (A1) | | | | | | | | | |
| A1-1 | mass % | 10.5 | 10.5 | 4.2 | 4.2 | 3.5 | — | — | — |
| (in terms of B) | mass ppm | 2835 | 2835 | 1138 | 1138 | 945 | 0 | 0 | 0 |
| (in terms of Ca) | mass ppm | 7350 | 7350 | 2950 | 2950 | 2450 | 0 | 0 | 0 |
| Component (A2) | | | | | | | | | |
| A2-1 | mass % | — | — | 3.5 | 3.5 | 3.9 | 11.8 | — | — |
| A2-2 | mass % | — | — | — | — | — | — | 6.25 | — |
| A2-3 | mass % | — | — | 2.4 | 2.4 | 2.7 | — | — | 8 |
| (in terms of Ca) | mass ppm | 0 | 0 | 4450 | 4450 | 4950 | 7400 | 7400 | 7400 |
| B-1 | mass % | — | 3 | — | 3 | — | — | — | — |
| C-2 | mass % | — | 0.95 | — | 0.95 | — | — | — | — |
| D-1 | mass % | — | 0.5 | — | 0.5 | — | — | — | — |
| Pour point depressant | mass % | — | 0.1 | — | 0.1 | — | — | — | — |
| Defoaming agent | mass % | — | 0.002 | — | 0.002 | — | — | — | — |
| Kinematic viscosity (100° C.) | $mm^2/s$ | 14.5 | 14.5 | 14.5 | 14.5 | 14.5 | 14.5 | 14.5 | 14.5 |
| Base number | mgKOH/g | 20 | 20 | 20 | 20 | 20 | 20 | 20 | 20 |
| B/Ca molar ratio | | 1.43 | 1.43 | 0.57 | 0.57 | 0.47 | 0 | 0 | 0 |
| CaO integrated intensity ratio | % | 0 | 0 | 14.5 | 14.5 | 19.6 | 94.5 | 72.3 | 59.7 |
| Released heat in carbonation test | J/g | 0 | 0 | 0 | 0 | 342 | 1290 | 423 | 219 |

TABLE 3

| | | Examples | | | Comparative examples | | | |
|---|---|---|---|---|---|---|---|---|
| | | 10 | 11 | 12 | 11 | 12 | 13 | 14 |
| Base oil | | | | | | | | |
| Base oil 2 | mass % | 64 | 64 | 64 | 64 | 64 | 64 | 64 |
| Base oil 3 | mass % | 35 | 35 | 35 | 35 | 35 | 35 | 35 |
| Component (A1) | | | | | | | | |
| A1-1 | mass % | 6.5 | 6.5 | 6.5 | — | — | 5 | 5 |
| (in terms of B) | mass ppm | 1755 | 1755 | 1755 | 0 | 0 | 1350 | 1350 |
| (in terms of Ca) | mass ppm | 4550 | 4550 | 4550 | 0 | 0 | 3500 | 3500 |
| Component (A2) | | | | | | | | |
| A2-1 | mass % | 10.4 | 10.4 | — | 17.6 | — | — | 12.1 |
| A2-3 | mass % | — | — | 7.05 | — | 12 | 8.2 | — |
| (in terms of Ca) | mass ppm | 6550 | 6550 | 6520 | 11100 | 11100 | 7600 | 7600 |
| B-1 | mass % | — | 3 | — | — | — | — | — |
| C-2 | mass % | — | 0.4 | — | — | — | — | — |
| D-1 | mass % | — | 0.5 | — | — | — | — | — |
| Kinematic viscosity (100° C.) | $mm^2/s$ | 20.0 | 20.0 | 20.0 | 20.0 | 20.0 | 20.0 | 20.0 |
| Base number | mgKOH/g | 30 | 30 | 30 | 30 | 30 | 30 | 30 |
| B/Ca molar ratio | | 0.59 | 0.59 | 0.59 | 0 | 0 | 0.45 | 0.45 |
| CaO integrated intensity ratio | % | 0 | 0 | 0 | 93.5 | 71.2 | 17 | 22.4 |
| Released heat in carbonation test | J/g | 0 | 0 | 0 | 1231 | 405 | 98 | 440 |

<Evaluation Results>

For any of the lubricating oil compositions for turbocharged gasoline engines (Examples 1 to 5 and Comparative Examples 1 to 6, Table 1), the lubricating oil compositions for premix combustion medium-speed trunk piston diesel engines (Examples 6 to 9 and Comparative Examples 7 to 10, Table 2) and the lubricating oil compositions for cylinders for premix combustion crosshead diesel engines (Examples 10 to 12 and Comparative Examples 11 to 14, Table 3), compositions of inventive examples, which had integrated intensity ratios of peaks of CaO in a X-ray diffraction spectrum of 16.5% or less, did not show heat evolution in the carbonation test. From these results, it is understood that the lubricating oil composition for an internal combustion engine and the method for lubricating an internal combustion engine of the present invention can suppress preignition derived from a reaction of ash scattered in a cylinder and carbon dioxide.

Any of compositions of inventive examples, which had a molar ratio B/Ca of a boron content and a calcium content derived from the component (A) (metallic detergent) of 0.52 or more, had an integrated intensity ratio of peaks of CaO in a X-ray diffraction spectrum of 16.5% or less.

The lubricating oil composition of Comparative Example 6 (Table 1) contained a boron-containing ashless dispersant as an ashless dispersant, and thus the B/Ca molar ratio would have become 0.58 if the contribution of the boron content from the ashless dispersant (312 mass ppm) had been incorporated to the boron content B. The integrated intensity ratio of peaks of CaO in its X-ray diffraction spectrum, however, was as large as 40.1%, and released heat in the carbonation test was as much as 660 J/g.

Reference Examples 1 to 9

Compositions prepared by mixing (A1) calcium borate-containing Ca salicylate (Ca content: 7.0 mass %, B content: 2.5 mass %) and (A2) calcium carbonate-containing Ca salicylate (Ca content: 6.4 mass %, B content: 0 mass %) at a mixing mass ratio of 0:100 to 100:0 were respectively incinerated at 950° C. in an air in the same way as described above. The obtained ashes were respectively evaluated by the powder X-ray diffraction analysis and the carbonation test in the same way as described above. The results are shown in Table 4. In Table 4, the rows of "integrated intensity ratio" show integrated intensity ratios in each X-ray diffraction spectrum for an ash content detected other than CaO.

TABLE 4

| | | Reference examples | | | | | | | | |
|---|---|---|---|---|---|---|---|---|---|---|
| | | 1 | 2 | 3 | 4 | 5 | 6 | 7 | 8 | 9 |
| Metallic detergent | | | | | | | | | | |
| (A1) Ca borate-containing Ca salicylate | mass % | 0 | 10.2 | 25.1 | 30.0 | 35.0 | 40.0 | 50.2 | 74.8 | 100 |
| (A2) Ca carbonate-containing Ca salicylate | mass % | 100 | 89.8 | 74.9 | 70.0 | 65.0 | 60.0 | 49.8 | 25.2 | 0 |
| Element in mixture | | | | | | | | | | |
| Ca | mass % | 6.40 | 6.46 | 6.55 | 6.58 | 6.61 | 6.64 | 6.70 | 6.85 | 7.00 |
| B | mass % | 0.00 | 0.26 | 0.63 | 0.75 | 0.88 | 1.00 | 1.26 | 1.87 | 2.50 |
| B/Ca molar ratio | | 0.0 | 0.15 | 0.36 | 0.42 | 0.49 | 0.56 | 0.69 | 1.01 | 1.32 |

TABLE 4-continued

| | | Reference examples | | | | | | | | |
|---|---|---|---|---|---|---|---|---|---|---|
| | | 1 | 2 | 3 | 4 | 5 | 6 | 7 | 8 | 9 |
| Integrated intensity ratio | | | | | | | | | | |
| CaO | % | 97.2 | 85.6 | 57.5 | 27.4 | 17.4 | 14.9 | 0.0 | 0.0 | 0.0 |
| $CaCO_3$ | % | 0.0 | 0.0 | 0.0 | 0.0 | 0.0 | 0.0 | 0.0 | 0.0 | 0.0 |
| $CaSO_4$ | % | 1.2 | 0.0 | 0.0 | 0.0 | 0.0 | 0.0 | 0.0 | 0.0 | 0.0 |
| $Ca(OH)_2$ | % | 1.6 | 0.0 | 0.0 | 12.8 | 12.3 | 0.0 | 0.0 | 0.0 | 0.0 |
| MgO | % | 0.0 | 0.0 | 0.0 | 0.0 | 0.0 | 0.0 | 0.0 | 0.0 | 0.0 |
| $CaB_2O_4$ | % | 0.0 | 0.0 | 0.0 | 0.0 | 0.0 | 0.0 | 0.0 | 11.1 | 54.8 |
| $Ca_2B_2O_5$ | % | 0.0 | 0.0 | 0.0 | 0.0 | 0.0 | 0.0 | 14.7 | 88.9 | 45.2 |
| $Ca_3(BO_3)_2$ | % | 0.0 | 14.4 | 42.5 | 59.8 | 70.4 | 85.1 | 85.3 | 0.0 | 0.0 |
| Carbonation test | | | | | | | | | | |
| Released heat | J/g | 1376 | 1065 | 572 | 569 | 311 | 0 | 0 | 0 | 0 |

FIG. 1 is a graph which plots released heat in the carbonation test in Table 4 against integrated intensity ratios of CaO in a X-ray diffraction spectrum of ash. It is understood from FIG. 1 that released heat in the carbonation test steeply increases from 0 J/g when the CaO integrated intensity ratio goes beyond 16.5%.

Figure 2:
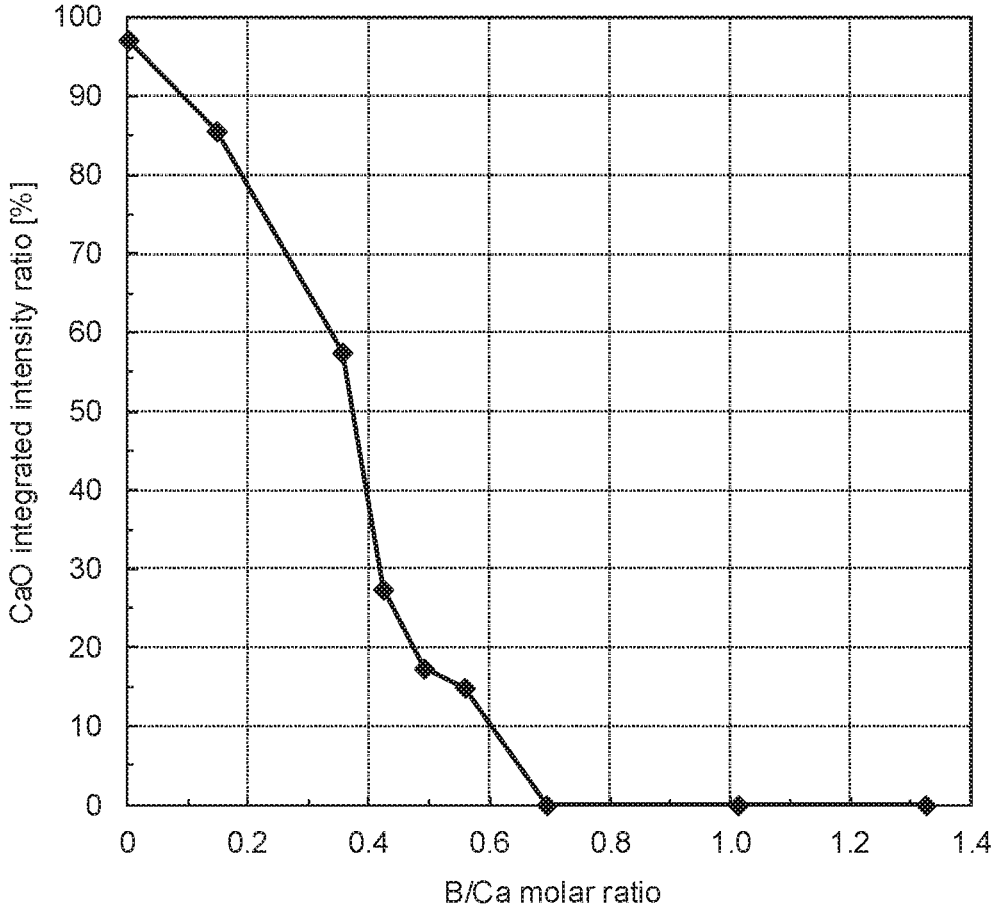
FIG. 2 is a graph showing a relation between molar ratios (B/Ca) of a boron content B and a calcium content Ca each derived from metallic detergents in Reference Examples, and the integrated intensity ratios of peaks derived from CaO in the X-ray diffraction spectra of the ashes.

FIG. 2 is a graph which plots integrated intensity ratios of CaO in X-ray diffraction spectra of ash against the molar ratio B/Ca of the metallic detergent mixtures. It is understood from FIG. 2 that the CaO integrated intensity ratio becomes 16.5% or less when the molar ratio B/Ca of the metallic detergent becomes 0.52 or more.

At a temperature of 950° C., at which the incineration was carried out, calcium carbonate liberates carbon dioxide to form CaO. A soap content of a Ca salicylate also forms CaO when being incinerated. As can be seen from Table 4, however, CaO was not detected in ash of not only in the composition of Reference Example 9 but also in the compositions of Reference Examples 7 and 8, which comprised calcium carbonate.

As can be seen from Table 4, in the X-ray diffraction spectra of ashes of Reference Examples 1 to 9, various calcium borates having different B/Ca ratios were detected. In the ash of the composition of Reference Example 9, which consisted of the component (A1), a calcium borate having a high B/Ca ratio, $CaB_2O_4$, was dominant. In the ash of the mixture of Reference Example 8, which comprised about 25 mass % of the component (A2), a calcium borate having a lower B/Ca ratio, $Ca_2B_2O_5$, became dominant. In the ash of the mixture of Reference Example 7, which comprised a greater amount of the component (A2), a calcium borate having a further lower B/Ca ratio, $Ca_3(BO_3)_2$, was formed. When the component (A2) was further increased, calcium borates other than $Ca_3(BO_3)_2$, which has the lowest B/Ca ratio, disappeared, and CaO began to be detected in ash (Reference Example 6 and Reference Examples 1 to 5).

From these results, it is understood that calcium borate reduces CaO in ash by absorbing CaO to form calcium borate of a lower B/Ca ratio when being incinerated.

I claim:

1. A cylinder lubricating oil composition for a premix combustion crosshead diesel engine, the lubricating oil composition comprising:

a mineral base oil or a synthetic base oil or a mixture thereof, as a lubricant base oil; and (A) a metallic detergent, the component (A) comprising:

(A1) a calcium borate-overbased metallic detergent in an amount of 0.35 to 1.70 mass % in terms of calcium on the basis of the total mass of the composition, the component (A1) comprising a calcium borate-overbased calcium salicylate detergent, or a calcium borate-overbased calcium sulfonate detergent, or any combination thereof; and (A2) a calcium carbonate-overbased metallic detergent in an amount of 0.35 to 1.30 mass % in terms of calcium on the basis of the total mass of the composition, the component (A2) comprising a calcium carbonate-overbased calcium salicylate detergent, or a calcium carbonate-overbased calcium sulfonate detergent, or any combination thereof, wherein an integrated intensity ratio of peaks of CaO in a X-ray diffraction spectrum of an ash is no more than 16.5%, the ash being obtained by incinerating the lubricating oil composition in an air at 950° C.;

a molar ratio B/Ca of a boron content B (unit: mol) of the lubricating oil composition derived from the component (A) and a calcium content Ca (unit: mol) of the lubricating oil composition derived from the component (A) is no less than 0.52; and the lubricating oil composition is used to lubricate at least a cylinder in a premix combustion crosshead diesel engine, wherein the premix combustion crosshead diesel engine uses a main fuel having a flash point of no more than 15° C.

2. The lubricating oil composition according to claim 1, further comprising:

one or more selected from the group consisting of: (B) an ashless dispersant, (C) a phosphorus-containing anti-wear agent, (D) an amine antioxidant, and (E) an oil-soluble organic molybdenum compound.

3. The lubricating oil composition according to claim 1, wherein the component (A1) consists of the calcium borate-overbased calcium salicylate detergent, or the calcium borate-overbased calcium sulfonate detergent, or any combination thereof; and the molar ratio B/Ca is 0.52 to 1.43.

4. The lubricating oil composition according to claim 1, wherein the lubricating oil composition has a kinematic viscosity at 100° C. of 16.3 to 21.9 $mm^2/s$.

5. A method for lubricating a cylinder of a premix combustion crosshead diesel engine, comprising:

a) supplying the lubricating oil composition as defined in claim 1 to a cylinder of a premix combustion crosshead diesel engine, wherein the premix combustion cross-head diesel engine has a mean effective pressure of no less than 1.3 MPa; and b) making a main fuel ignite in the cylinder, wherein the main fuel has a flash point of no more than 15° C.

6. The method according to claim 5, wherein the main fuel consists of a $C_{1-4}$ hydrocarbon, or dimethyl ether, or any combination thereof.

7. The method according to claim 6, wherein the b) making a main fuel ignite in the cylinder comprises:

i) compressing a fuel-air mixture of the main fuel and an air in the cylinder; and ii) injecting a pilot fuel into the cylinder, to ignite the fuel-air mixture, wherein the pilot fuel consists of a heavy fuel oil, a light fuel oil, or kerosene, or any combination thereof.

8. A lubricating oil composition for a premix combustion middle-speed trunk piston diesel engine, the lubricating oil composition comprising:

a mineral base oil or a synthetic base oil or a mixture thereof, as a lubricant base oil; and (A) a metallic detergent, the component (A) comprising:

(A1) a calcium borate-overbased metallic detergent in an amount of 0.25 to 1.20 mass % in terms of calcium on the basis of the total mass of the composition, the component (A1) comprising a calcium borate-overbased calcium salicylate detergent, or a calcium borate-overbased calcium sulfonate detergent, or any combination thereof; and (A2) a calcium carbonate-overbased metallic detergent in an amount of 0.25 to 0.90 mass % in terms of calcium on the basis of the total mass of the composition, the component (A2) comprising a calcium carbonate-overbased calcium salicylate detergent, or a calcium carbonate-overbased calcium sulfonate detergent, or any combination thereof, wherein an integrated intensity ratio of peaks of CaO in a X-ray diffraction spectrum of an ash is no more than 16.5%, the ash being obtained by incinerating the lubricating oil composition in an air at 950° C.;

a molar ratio B/Ca of a boron content B (unit: mol) of the lubricating oil composition derived from the component (A) and a calcium content Ca (unit: mol) of the lubricating oil composition derived from the component (A) is no less than 0.52; and the lubricating oil composition is used to lubricate at least a cylinder in a premix combustion middle-speed trunk piston diesel engine, wherein the premix combustion middle-speed trunk piston diesel engine uses a main fuel having a flash point of no more than 15° C.

9. The lubricating oil composition according to claim 8, further comprising:

one or more selected from the group consisting of: (B) an ashless dispersant, (C) a phosphorus-containing anti-wear agent, (D) an amine antioxidant, and (E) an oil-soluble organic molybdenum compound.

10. The lubricating oil composition according to claim 8, wherein the component (A1) consists of the calcium borate-overbased calcium salicylate detergent, or the calcium borate-overbased calcium sulfonate detergent, or any combination thereof; and the molar ratio B/Ca is 0.52 to 1.43.

11. The lubricating oil composition according to claim 8, wherein the lubricating oil composition has a kinematic viscosity at 100° C. of no less than 9.3 $mm^2/s$ and less than 16.3 $mm^2/s$.

12. A method for lubricating a premix combustion middle-speed trunk piston diesel engine, the method comprising:

a) supplying the lubricating oil composition as defined in claim 8 to a cylinder of a premix combustion middle-speed trunk piston diesel engine, wherein the premix combustion middle-speed trunk piston diesel engine has a mean effective pressure of no less than 1.3 MPa; and b) making a main fuel ignite in the cylinder, wherein the main fuel has a flash point of no more than 15° C.

13. The method according to claim 12, wherein the main fuel consists of a $C_{1-4}$ hydrocarbon, or dimethyl ether, or any combination thereof.

14. The method according to claim 13, wherein the b) making a main fuel ignite in the cylinder comprises:

i) compressing a fuel-air mixture of the main fuel and an air in the cylinder; and ii) injecting a pilot fuel into the cylinder, to ignite the fuel-air mixture, wherein the pilot fuel consists of a heavy fuel oil, a light fuel oil, or kerosene, or any combination thereof.

15. A lubricating oil composition for a turbocharged gasoline engine, the lubricating oil composition comprising:

a mineral base oil or a synthetic base oil or a mixture thereof, as a lubricant base oil; and (A) a metallic detergent, the component (A) comprising:

(A1) a calcium borate-overbased metallic detergent in an amount of 0.10 to 0.28 mass % in terms of calcium on the basis of the total mass of the composition, the component (A1) comprising a calcium borate-overbased calcium salicylate detergent, or a calcium borate-overbased calcium sulfonate detergent, or any combination thereof; and (A2) a calcium carbonate-overbased metallic detergent in an amount of 0.10 to 0.18 mass % in terms of calcium on the basis of the total mass of the composition, the component (A2) comprising a calcium carbonate-overbased calcium salicylate detergent, or a calcium carbonate-overbased calcium sulfonate detergent, or any combination thereof, wherein an integrated intensity ratio of peaks of CaO in a X-ray diffraction spectrum of an ash is no more than 16.5%, the ash being obtained by incinerating the lubricating oil composition in an air at 950° C.;

a molar ratio B/Ca of a boron content B (unit: mol) of the lubricating oil composition derived from the component (A) and a calcium content Ca (unit: mol) of the lubricating oil composition derived from the component (A) is no less than 0.52; and the lubricating oil composition is used to lubricate at least a cylinder in a turbocharged gasoline engine.

16. The lubricating oil composition according to claim 15, further comprising:

one or more selected from the group consisting of: (B) an ashless dispersant, (C) a phosphorus-containing anti-wear agent, (D) an amine antioxidant, and (E) an oil-soluble organic molybdenum compound.

17. The lubricating oil composition according to claim 15, wherein the component (A1) consists of the calcium borate-overbased calcium salicylate detergent, or the calcium borate-overbased calcium sulfonate detergent, or any combination thereof; and the molar ratio B/Ca is 0.52 to 1.43.

18. The lubricating oil composition according to claim 15, wherein the lubricating oil composition has a kinematic viscosity at 100° C. of no less than 4.0 $mm^2/s$ and less than 9.3 $mm^2/s$.

19. A method for lubricating a premix combustion turbocharged gasoline engine, the method comprising:

a) supplying the lubricating oil composition as defined in claim 15 to a cylinder of a turbocharged gasoline engine, wherein the turbocharged gasoline engine has a mean effective pressure of no less than 1.3 MPa; and b) making a fuel ignite in the cylinder, wherein the fuel consists of gasoline.

* * * * *